US011244655B2

(12) United States Patent
Xiao et al.

(10) Patent No.: US 11,244,655 B2
(45) Date of Patent: Feb. 8, 2022

(54) METHOD AND ELECTRONIC DEVICE FOR MODULATING BRIGHTNESS-GRAYSCALE CURVE OF DISPLAY DEVICE

(71) Applicants: BOE INTELLIGENT IOT TECHNOLOGY CO., LTD., Beijing (CN); BOE TECHNOLOGY GROUP CO., LTD., Beijing (CN)

(72) Inventors: Xiangchun Xiao, Beijing (CN); Heliang Di, Beijing (CN); Xuguang Jia, Beijing (CN)

(73) Assignees: BOE INTELLIGENT IOT TECHNOLOGY CO., LTD, Beijing (CN); BOE TECHNOLOGY GROUP CO., LTD., Beijing (CN)

( * ) Notice: Subject to any disclaimer, the term of this patent is extended or adjusted under 35 U.S.C. 154(b) by 0 days.

(21) Appl. No.: 17/273,789

(22) PCT Filed: Sep. 10, 2019

(86) PCT No.: PCT/CN2019/105161
§ 371 (c)(1),
(2) Date: Mar. 5, 2021

(87) PCT Pub. No.: WO2020/052555
PCT Pub. Date: Mar. 19, 2020

(65) Prior Publication Data

US 2021/0335324 A1 Oct. 28, 2021

(30) Foreign Application Priority Data

Sep. 10, 2018 (CN) ..... 201811051290.7

(51) Int. Cl.
*G09G 5/10* (2006.01)
*G09G 3/36* (2006.01)

(52) U.S. Cl.
CPC ..... *G09G 5/10* (2013.01); *G09G 3/3607* (2013.01); *G09G 2310/027* (2013.01); *G09G 2320/0233* (2013.01); *G09G 2320/0646* (2013.01)

(58) Field of Classification Search
CPC .. G09G 5/10; G09G 3/3607; G09G 2310/027; G09G 2320/0233; G09G 2320/0646
See application file for complete search history.

(56) References Cited

U.S. PATENT DOCUMENTS 10,192,521 B2 1/2019 Xiao
2006/0061842 A1* 3/2006 Oka ..... H04N 9/69 358/522

(Continued)

FOREIGN PATENT DOCUMENTS

CN 101052110 A 10/2007
CN 103247282 A 8/2013

(Continued)

*Primary Examiner* — Antonio Xavier
(74) *Attorney, Agent, or Firm* — Dilworth & Barrese, LLP.; Michael J. Musella, Esq.

(57) ABSTRACT

A method and device for modulating a brightness-grayscale curve of a display device are provided. The method includes determining an applicable standard brightness-grayscale curve for eye perception; obtaining theoretical brightness values corresponding to respective grayscales of the display device based on the applicable standard brightness-grayscale curve for eye perception and at least one of an eye pupil change factor, an environmental factor and a factor related to the display device; modulating brightnesses of the display device according to the theoretical brightness values corresponding to the respective grayscales of the display device. The above method is a solution to the problems of low grayscale details, backlighting, high grayscale saturation, and transition-color unevenness. The problem is solved that a visible grayscale in a dimmed session is no longer (Continued)

distinguishable in a bright environment. And a quantifiable standard for modulation control is provided.

13 Claims, 10 Drawing Sheets

(56) References Cited

U.S. PATENT DOCUMENTS

| | | | | |
|---|---|---|---|---|
| 2010/0026942 | A1* | 2/2010 | Fukukawa | G02F 1/133555 349/114 |
| 2011/0175925 | A1* | 7/2011 | Kane | H04N 21/42202 345/589 |
| 2015/0145777 | A1* | 5/2015 | He | G06F 3/0325 345/158 |
| 2016/0171704 | A1* | 6/2016 | Raghoebardajal | G06K 9/4661 345/633 |
| 2017/0206825 | A1* | 7/2017 | Cha | G09G 3/3208 |
| 2018/0040295 | A1* | 2/2018 | Deng | G09G 5/10 |
| 2018/0197504 | A1* | 7/2018 | Xiao | G09G 5/10 |

FOREIGN PATENT DOCUMENTS

| | | | | |
|---|---|---|---|---|
| CN | 105244008 | A | | 1/2016 |
| CN | 105623460 | A | * | 6/2016 |
| CN | 105632460 | A | | 6/2016 |
| JP | 2008129334 | A | | 6/2008 |

* cited by examiner

METHOD AND ELECTRONIC DEVICE FOR MODULATING BRIGHTNESS-GRAYSCALE CURVE OF DISPLAY DEVICE

CROSS-REFERENCE TO RELATED APPLICATION

The present application claims priority of the Chinese Patent Application No. 201811051290.7, filed on Sep. 10, 2018, the disclosure of which is incorporated herein by reference in its entirety as part of the present application.

TECHNICAL FIELD

The present disclosure relates to a field of display technology, and more specifically, the present disclosure relates to a method and an electronic device for modulating a brightness-grayscale curve of a display device.

BACKGROUND

In a field of display technology, after the preparation of the display panel, the brightnesses of respective grayscales are usually modulated according to a gamma curve, so that an accurate display for different brightnesses of an image can be reproduced by the display panel when the image is displayed.

How to improve the display accuracy of the display panel for different brightnesses in the image is an important topic in the field of display technology and research.

SUMMARY

In view of this, a method and an apparatus and an electronic device for modulating a brightness-grayscale curve of a display device are provided by the present disclosure.

In a first aspect, a method for modulating a brightness-grayscale curve of a display device is provided by the embodiments of the present disclosure. The method includes: obtaining theoretical brightness values of respective grayscales of the display device according to a maximum brightness value of the display device, a minimum brightness value of the display device, a maximum grayscale value of the display device, and a gamma parameter related to the display environment; modulating brightnesses of the display device according to the theoretical brightness values corresponding to the respective grayscales of the display device.

According to the embodiments of the present disclosure, the obtaining theoretical brightness values of respective grayscales of the display device according to a maximum brightness value of the display device, a minimum brightness value of the display device, a maximum grayscale value of the display device, and a gamma parameter associated with the display environment includes: obtaining an intermediate factor according to the maximum brightness value of the display device, the minimum brightness value of the display device, the maximum grayscale value of the display device, and the gamma parameter related to the display environment; obtaining the theoretical brightness values for the respective grayscales of the display device according to the maximum brightness value of the display device, the maximum grayscale value of the display device, and the intermediate factor.

According to the embodiments of the present disclosure, the obtaining theoretical brightness values of respective grayscales of the display device according to a maximum brightness value of the display device, a minimum brightness value of the display device, a maximum grayscale value of the display device, and a gamma parameter related to the display environment includes: determining a specific gamma curve according to the maximum brightness value of the display device, the minimum brightness value of the display device, the maximum grayscale value of the display device, and the gamma parameter related to the display environment; obtaining the theoretical brightness values corresponding to the respective grayscales of the display device according to the specific gamma curve; wherein, the intermediate factor of the specific gamma curve is determined based on the maximum brightness value of the display device, the minimum brightness value of the display device, the maximum grayscale value of the display device, and the gamma parameter related to the display environment.

According to the embodiments of the present disclosure, the intermediate factor is determined according to the following formula:

$$n_0 = \frac{n_{max}}{\left(\frac{L_{device-max}}{L_{device-min}}\right)^{\frac{1}{\gamma}} - 1}$$

wherein, $L_{device-max}$ is the maximum brightness value of the display device, $L_{device-min}$ is the minimum brightness value of the display device, $n_{max}$ is the maximum grayscale value of the display device, $\gamma$ is the gamma parameter related to the display environment, and $n_0$ is the intermediate factor.

According to the embodiments of the present disclosure, the theoretical brightness values corresponding to the respective grayscales of the display device are obtained according to the following formula:

$$L_{physic}(n) = L_{physic-max} * \left(\frac{n + n_0}{n_{max} + n_0}\right)^{\gamma}$$

wherein, $L_{physic-max}$ is the maximum brightness value of the display device, $n_{max}$ is the maximum grayscale value of the display device, $n_0$ is the intermediate factor, n is each grayscale of the display device, $L_{physic}(n)$ is a theoretical brightness value corresponding to the grayscale n of the display device, and $\gamma$ is the gamma parameter related to the display environment.

Furthermore, according to the embodiments of the present disclosure, the gamma parameter is in the range from 2.0 to 2.4.

Furthermore, according to the embodiments of the present disclosure, the gamma parameter is determined based on the value of an environmental factor. When the value of the environmental factor belongs to a first environmental parameter range, the value of the gamma parameter belongs to a first gamma parameter range; when the value of the environmental factor belongs to a second environmental parameter range, the value of the gamma parameter belongs to a second gamma parameter range; wherein, the values in the first environmental parameter range are greater than the values in the second environmental parameter range, and the values in the first gamma parameter range are less than the values in the second gamma parameter range.

According to the embodiments of the present disclosure, for each of the respective grayscales, the obtained ratio of the theoretical brightness value corresponding to the grayscale in the display device to the actual measured brightness value corresponding to the grayscale of a modulated display device satisfies a first range, and/or the obtained ratio of the theoretical brightness difference corresponding to the grayscale of the display device to the actual measured brightness difference corresponding to the grayscale in the modulated display device satisfies a second range.

Furthermore, according to the embodiments of the present disclosure, the first range is from 1−15% to 1+15%, and the second range is from 1−30% to 1+30%.

Furthermore, according to the embodiments of the present disclosure, a standard deviation between the obtained theoretical brightness values corresponding to the respective grayscales of the display device and the actual measured brightness values corresponding to the respective grayscales of the modulated display device satisfies a third range, or the maximum difference between the obtained theoretical brightness values corresponding to the respective grayscales of the display device and the actual measured brightness values corresponding to the respective grayscales of the modulated display device satisfies a fourth range.

Furthermore, according to the embodiments of the present disclosure, the eye pupil change factor comprises a value corresponding to a ratio of a diameter of the eye pupil at current environment brightness to a diameter of the eye pupil at predefined environment brightness.

In another aspect, according to the embodiments of the present disclosure, a method for modulating a brightness-grayscale curve of a display device is provided. The method includes: determining an applicable standard brightness-grayscale curve for eye perception; obtaining theoretical brightness values corresponding to respective grayscales of the display device based on the applicable standard brightness-grayscale curve for eye perception and at least one of an eye pupil change factor, an environmental factor and a factor related to the display device; modulating brightnesses of the display device according to the theoretical brightness values corresponding to the respective grayscales of the display device.

In another aspect, according to the embodiments of the present disclosure, an electronic device is provided. The electronic device includes a display device, a memory, and a processor. The processor is coupled to the display device and the memory respectively, the memory stores instructions, wherein the above method for modulating is executed when the instructions are executed by the processor.

In another aspect, according to the embodiments of the present disclosure, a non-transient computer-readable recording medium is provided, on which a program for performing the above method for modulating is recorded.

In the method, the apparatus and the electronic device for modulating a brightness-grayscale curve of a display device according to the embodiments of the present disclosure, an applicable standard brightness-grayscale curve for eye perception is determined; theoretical brightness values corresponding to the respective grayscales of the display device are obtained based on the applicable standard brightness-grayscale curve for eye perception and at least one of an eye pupil change factor, an environmental factor and a factor related to the display device; and the brightness of the display device is modulated according to the theoretical brightness values corresponding to the respective grayscales of the display device. The above method is a solution to the problems of low grayscale details, backlighting, high grayscale saturation, and transition-color unevenness and the like caused by modulation of the display device using the ideal gamma curve. By considering the effect of environmental factors on eye perception, the above method is also a solution to the problem that the modulating of a display device with an ideal gamma curve would cause the visible grayscale in a dimmed session to be no longer distinguishable in a bright environment. And a quantifiable standard is provided, which fills a gap for standards in the display field.

It should be understood that both the preceding general description and the following detailed description are exemplary and are intended to provide a further description of the technology for which protection is claimed.

BRIEF DESCRIPTION OF THE DRAWINGS

In order to more clearly explain the technical schemes of the embodiments of the present application, the drawings of the embodiments will be briefly introduced. It should be understood that the drawings in the following description refer to only some of the embodiments of the present application and are not intended to limit the scope of the embodiments of the present application. Other relevant drawings can be obtained based on these drawings without any creative labor for those skilled in the art.

DETAILED DESCRIPTION

Figure 1A:
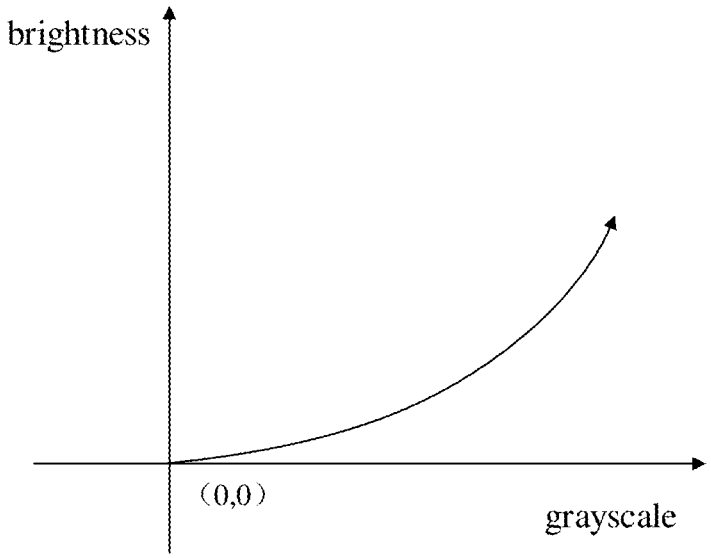
FIG. 1A is a diagram illustrating a first gamma curve according to the embodiments of the present disclosure.

The technical scheme of the embodiments of the present application will be clearly and completely described as follows, with reference to the drawings of the embodiments of the present disclosure. Obviously, the described embodiments are part of the embodiments of the present disclosure, not all of the embodiments. The components of the embodiments of the present disclosure generally described and illustrated in the drawings herein may be arranged and designed in a variety of different configurations. Therefore, the following detailed description of embodiments of the disclosure provided in the accompanying drawings is not intended to limit the scope of the claimed disclosure, but merely represents selected embodiments of the disclosure. Based on the embodiments of the present disclosure, all other embodiments obtained by those skilled in the art without creative labor are within the scope of the present disclosure.

It should be noted that like reference numerals and letters indicate like items in the following drawings. Thus once an item is defined in one drawing, further definition and explanation may be not needed in the following drawings. Meanwhile, in the description of the present disclosure, the terms "first", "second" and the like are used for distinguishing description only and cannot be understood as indicating or implying relative importance.

Dissemination of video information goes through three stages: 1) a capturing stage, in which optical information is converted into electrical signals, which are then stored or disseminated; 2) a transmission stage, in which there are two main methods of transmission: transmission by analog or digital; 3) a display stage, in which the display device that receives the electrical signal converts the electrical signal into an optical signal for visual presentation.

During these three stages, standards were developed so that the correct image could be observed by a user. In the display stage, in order to properly display the captured video signal in the display device, a series of industry standards have been developed. When the electrical signal is converted into the optical signal to be displayed in the display device, the series of industry standards determine, for each of different grayscales, the correspondence between the grayscale and the brightness value of the displayed optical signal. This correspondence is often called as an electro-optical conversion function (EOTF). Although material selections and design principles of display devices vary, after applying the electro-optical conversion function, the grayscale can be uniformly converted to the brightness value of the optical signal, so that screen brightness value with a uniform standard can be displayed by all display devices.

Usually, it is easy to overlook the following issues: 1) the eye perception of the image is influenced by the environment, such as too bright or too dark environment light will interfere with the eye's ability to discriminate the grayscale, resulting in a different perception of a screen; 2) whether the display device is able to fully display the desired image. This display capability is usually manifested in three areas: minimum brightness, maximum brightness, and color gamut. The minimum brightness is often overlooked.

Furthermore, the optical-electric conversion function (OETF) and the electro-optical conversion function (EOTF) is a relationship of a function and an inverse function. But due to the different display devices and the use environment, a simple general formula cannot meet the requirements of different users. Display devices and viewing venues have changed dramatically compared to the theater setting and the CRT era.

Figure 1B:
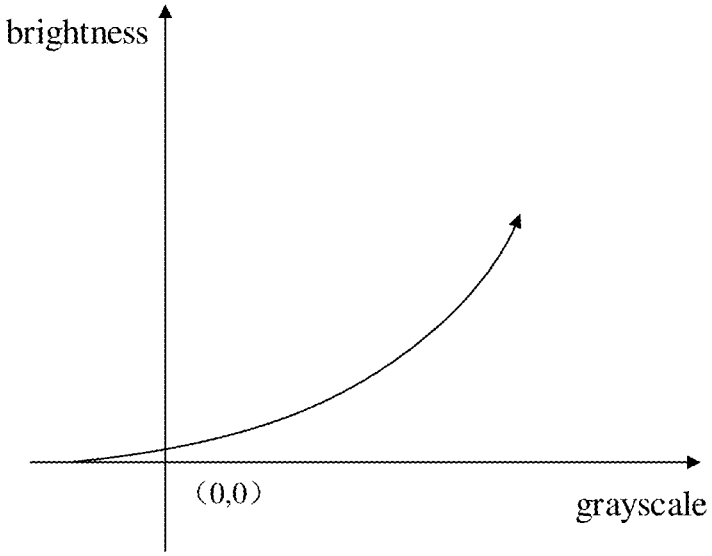
FIG. 1B is a diagram illustrating a second gamma curve according to the embodiments of the present disclosure.

Specifically, see FIG. 1A, which is a schematic diagram illustrating an ideal gamma curve according to the embodiments of the present disclosure. For the ideal gamma curve, when the grayscale is 0, the corresponding brightness value is also 0. But in practice, when the grayscale of the display device is 0, its corresponding brightness value is not 0. If the CRT convention is still followed, the condition is ignored that the grayscale of the display device is 0 while its corresponding brightness value is not 0, and the display device is modulated by the ideal gamma curve, it will cause problems such as low grayscale details, backlighting, high grayscale saturation, and transition-color unevenness and so on. Therefore, a gamma curve as shown in FIG. 1B is needed that satisfies the requirement that a brightness value corresponding to a grayscale being 0 is not 0.

Moreover, when the effect of environment brightness on eye perception is ignored, modulation of the display device using the existing ideal electro-optical conversion curve will cause a problem that the visible grayscale in a dim environment is no longer distinguished in a bright environment.

In addition, in the current industry division in the field of display technology, for all aspects of the video signal from capturing, transmission, to display, the integrity of the data must be ensured in order to guarantee the final display effect. Liquid Crystal Display, as a display device for many manufacturers' end products, requires a fixed and quantifiable standard. However, there is no such standard, which is not enough for the field of display technology. To this end, three tiers of standards are proposed as follows by the present disclosure, corresponding to three curves.

1. An absolute standard for a brightness-grayscale curve of eye perception is proposed, which corresponds to an absolute standard curve of brightness-grayscale perceived by the eye. This curve is derived from physio-physical measurements of the eye's ability to perceive images.

Specifically, based on the results of the eye physiological tests, an absolute standard brightness-grayscale curve of eye perception is established in a state where the size of the pupil does not change while the eye is in a typical comfortable environment. The absolute standard brightness-grayscale curve of eye perception is based on physio-physical measurements in a standard environment, so this standard is an absolute standard. That is, for each grayscale, the brightness of eye perception corresponding to the grayscale is an absolute value, this grayscale is an absolute grayscale, and the brightness corresponding to the grayscale is called absolute perception brightness. The establishment of this standard contributes to guaranteeing the following characteristics of the standard: objectivity, uniqueness, direct relevance to the eye, and requiring a small quantity of the display data.

Figure 1C:
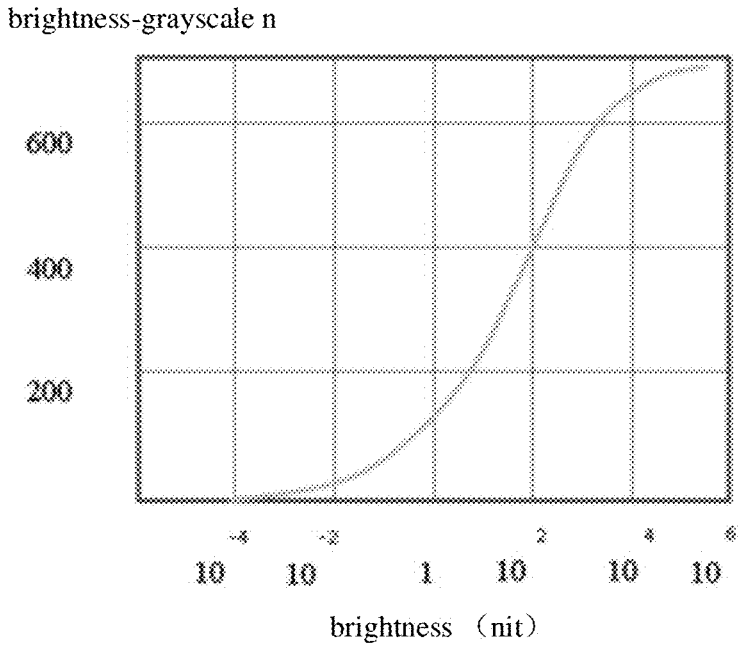
FIG. 1C is a diagram illustrating an actual-measured absolute standard brightness-grayscale curve for eye perception according to the embodiments of the present disclosure.

As an embodiment, the pupil diameter of the eye in a comfort state is $\Phi_0$=4 mm in a standard comfort environment (i.e., according to national standards, at an illumination degree of 200 lx and a lighting power density of 7 W/m$^2$). The eye's ability to perceive grayscale is measured, to obtain an absolute standard brightness-grayscale curve for eye perception. The brightness of this curve is an absolute brightness, which covers the range from the minimum brightness to the maximum brightness that the eye can perceive at that pupil diameter. As shown in FIG. 1C, the horizontal axis coordinates are brightness $L_n$ (nit) perceived by the eye and the vertical axis coordinates are grayscale n. The curve is represented as follows.

$$L_n=F(n)$$

where $L_n$ denotes the brightness perceived by the eye, n denotes the grayscale, and F( ) denotes the function.

2. An applicable standard for a brightness-grayscale curve of eye perception is proposed, which corresponds to an applicable standard curve of brightness-grayscale perceived by the eye. The curve is determined based on the absolute standard brightness-grayscale curve for eye perception. The curve is determined by taking into account at least one of the following factors: a digital information transmission condition, a historical condition of past standards, and a general capability (e.g., color depth, clarity, etc.) of the display device. The curve is compatible.

As an implementation, the absolute standard brightness-grayscale curve for eye perception can be subdivided by interpolation to meet the requirements of digital information transmission, according to the capability of the display device to express the color depth and the capability of the display device to output the maximum and minimum brightness. Thus, different applicable standard brightness-grayscale curves for eye perception are formed, for example, an applicable standard brightness-grayscale curve for eye perception with 256 grayscales at 8-bit color depth, an applicable standard brightness-grayscale curve for eye perception with 1024 grayscales at 10-bit color depth and the like.

As a specific embodiment, succeeding in the above example, the image is expressed using 256 grayscales in the range of 0 to 300 nit based on the absolute standard brightness-grayscale curve for eye perception $L_n$=F(n), in consideration of the binary characteristics of 8-bit color depth data transmission. The brightness difference between different grayscales thus expressed is less than the brightness difference between the grayscales in the absolute standard brightness-grayscale curve for eye perception. Thus, the applicable standard brightness-grayscale (256) curve for eye perception is obtained and expressed as follows.

$$L_n=F_{256}(n)(0<=n<256)$$

where $L_n$ denotes a brightness of the eye perception, n denotes a grayscale expressed by the 8-bit color depth data, 0<=n<256, $F_{256}$(n) denotes the function.

As an alternative embodiment, a little image quality can be sacrificed to form a compatible applicable standard brightness-grayscale curve for eye perception in consideration of historical reasons and playback of past image content.

3. A device standard for a brightness-grayscale curve (SEOTF) is proposed, which corresponds to a brightness-grayscale curve of a display device. On the basis of the proposed applicable standard of a brightness-grayscale curve for eye perception, a brightness-grayscale curve of the display device can be obtained based on at least one of a factor of human pupil variation, an environmental factor, and a factor related to the display device. An image is displayed by the display device according to the brightness-grayscale curve of the display device in its specified environment so that the output image information is formed on the human retina as closely as possible to the dissemination intention.

With the different display capabilities of different display devices and the characteristics of images perceived by the eye (insensitive to relative brightness) being taken into consideration, an image can be displayed by the display device with a relative brightness (the relative brightness can be a brightness difference less than the precision requirement on brightness difference of the absolute standard brightness-grayscale curve for eye perception) without exceeding the precision requirement on brightness difference of the absolute standard brightness-grayscale curve for eye perception.

Next, the modulation process of the display device is improved as follows by the present disclosure using the three tiers of standards (corresponding to the three curves) described above.

1. The absolute standard brightness-grayscale curve for eye perception is determined according to the test results in a standard environment.

2. Different levels of the applicable standard brightness-grayscale curve for eye perception are determined according to a digital information transmission condition, a condition of display devices, a history of past standards, and the absolute standard brightness-grayscale curve for eye perception, etc.

3. A theoretical brightness-grayscale curve of the display device (i.e., the theoretical brightness values corresponding to respective grayscales in the display device are obtained) is determined based on at least one of an eye pupil change factor, an environmental factor, and a factor related to the display device, and the applicable standard brightness-grayscale curve for eye perception.

4. Brightnesses of the display device are modulated according to the theoretical brightness-grayscale curve of the display device.

5. It is checked that the deviation of the brightness-grayscale curve of the actual modulated device from the theoretical brightness-grayscale curve it follows is within the range of the commissioning standard. That is to say, it is checked that the obtained ratio of the theoretical brightness values corresponding to respective grayscales in the display device to the actual measured brightness values corresponding to respective grayscales of the modulated display device satisfies a first range, and/or the obtained ratio of the theoretical brightness differences corresponding to respective grayscales of the display device to the actual measured brightness differences corresponding to respective grayscales in the modulated display device satisfies a second range, etc.

In addition, the processes of capturing, transmitting, and displaying image (or video) information are improved in this disclosure, as follows.

1. In the capturing stage, the image is captured by a capturing device, and each grayscale of the image is determined according to the applicable standard brightness-grayscale curve for eye perception.

2. In the transmission stage, the grayscale of each pixel of the image is digitally transmitted to the display device.

3. In the display stage, each grayscale of the image is received by the display device. The image is displayed by the display device in its specified environment based on the brightness-grayscale curve of the display device. After the action of the human refractive body, an image conforming to the applicable standard brightness-grayscale curve for eye perception is formed in the retina. In other words, a pixel that is intended to present an eye with a perceived brightness of L is digitally processed, transmitted, and displayed in the environment of the display device, and the visual experience of an eye with a perceived brightness of L is formed on the retina through the refractive body. Before detailed descriptions, a few concepts that are covered subsequently are explained.

$L_{device}(n)$ is a theoretical brightness value corresponding to grayscale n of the display device. The value of $L_{device}(n)$ is determined according to the physical brightness curve and the particular grayscale n. $L_{device}(n)$ and $L_{device}$ can be understood as equivalent in subsequent texts.

$L_{measure}(n)$ refers to the actual measured brightness value of grayscale n in the modulated display device, this brightness value is the actual measured physical brightness value. The value of $L_{measure}(n)$ may not match the value of $L_{device}(n)$ due to some of the limitations of the display device itself, but it is hoped that their values will be as consistent as possible to make the modulation work better.

$L_{perception}(n)$ is the optical brightness perceived by the eye after the modulation of the display device is complete. The value of $L_{perception}(n)$ is determined according to the applicable standard brightness-grayscale curve for eye perception and the particular grayscale n. $L_{perception}(n)$ and $L_{perception}$ can be understood as equivalents in a subsequent context. The value of $L_{perception}(n)$ may not match the value of $L_{device}(n)$ due to the peculiarities of the eye (the environment may affect eye) and some limitations of the display device itself, but it is hoped that after modulation, the image brightness $L_{perception}(n)$ perceived by the eye in the current environment will be as consistent as possible with the brightness $L_{device}(n)$ modulated by the display device.

Accordingly, in the present disclosure, a physical brightness-grayscale curve of a display device is determined according to the applicable standard brightness-grayscale curve for eye perception, in combination with at least one of an eye pupil change factor, an environmental factor and a factor related to the display device. The brightness modulated according to this physical brightness-grayscale curve can form a more reproducible image on the retina by the refractive system of the eye. A brief introduction to the eye pupil and the light-sensing process are given below. The shape of the eye is a sphere with a diameter of about 23 mm, and the pupil diameter can vary between 2 and 8 mm Rod-shaped cells are incapable of sensing color, but their sensitivity to light is 10,000 times higher than that of cone cells. Cone cells are sensitive to both light and color. In the presence of strong light, vision is dominated by cone cells, which is known as a bright-vision. In the case of low light, vision is dominated by rod cells, which is known as a dark-vision. Cone and rod cells are connected to the optic nerve via bipolar meridians, and optic nerve cells lead to the brain via optic nerve fibers.

The light-sensing process is broadly divided into four steps.

At a first step, light is imaged in the retina via the translucency lens. The photopigments in cone cells and rod cells are optic violet-blue matter and optic violet-red matter, respectively. Optic violet-blue matter and optic violet-red matter are chemically changed upon exposure to light. The chemical changes in these two are in opposite directions.

At a second step, the aforementioned optical changes cause a point on the retina to produce a potential proportional to the degree of illumination, which converts the light image on the retina into a potential image.

At a third step, the potentials at each point on the retina drive the corresponding optic nerve to discharge respectively. The discharge current is an electrical pulse with a constant amplitude and a frequency variable with the values of the retinal potentials.

At a fourth step, typically, 2 million frequency-coded electrical impulse signals are received by the visual cortex. These electrical impulse signals are first deposited respectively into the corresponding cellular special surface of the retinal photosensitive cells and then are subjected to the integrated image information processing to enable a person to have a vision of seeing the scene image.

The pupil diameters of the eye are different between a high light environment and a low light environment. As a result, the brightness projected onto the retina is different after passing through the refractive system. The brightness of an image pixel as perceived by the eye is proportional to the square of the diameter of the pupil. It may be assumed that the brightness perceived by the pupil of the eye in a comfort zone corresponds to the physical brightness of the subject. The so-called comfort zone is defined as an environment of an ordinary living room. As an implementation, the pupil diameter of the eye in comfort is $\Phi_0$=4 mm according to national standards (i.e., at an illumination of 200 lx and at an illumination power density of 7 W/m2), but of course, it is not limited to this.

Assuming that, according to physio-physical tests, when the pupil diameter of the eye is $\Phi$ in a certain environment, the relationship between the brightness perceived by the eye $L_{perception}$ and the theoretical physical brightness value of the display device $L_{device}$ is as follows.

$$L_{perception}=F_1(g(\phi,\phi_0),L_{device}) \quad (1)$$

where $g(\phi,\phi_0)$ is called a brightness perception factor function, $F_1(\ )$ denotes the function, $\Phi_0$ denotes a pupil diameter of the eye in comfort, and $\Phi$ denotes a pupil diameter of the eye in a certain environment.

In general, when the eye is in a comfortable environment, the transfer function of the refractive body can be considered as MTF=1. At this point, the perception ability of the visual cells is not affected by the pupil size. The incoming light flux into the fundus of the eye is equal to the light intensity multiplied by the area of the pupil. So the incoming light flux into the fundus of the eye is proportional to the square of the diameter of the pupil. The brightness $L_{perception}$ of a certain point of the image as perceived by the eye, with imaging invariance, is also proportional to the area of the pupil. Taking the light intensity approximation as $L_{device}$, now, the relationship between $L_{perception}$ and $L_{device}$ is as follows.

$$L_{perception}=g(\phi,\phi_0)*L_{device} \quad (2)$$

Further, an area of a pupil can be calculated from the formula $\pi R^2$, where R is the radius of the pupil. It can be found that when the radius of the pupil of the eye changes, the change in the incoming light flux is proportional to the square of the radius of the pupil. The following formula is given in order to simplify the calculation.

$$g(\phi,\phi_0=(\phi/\phi_0)^2 \quad (3)$$

where, $\Phi_0$ is the diameter of the pupil in the initial environment. For example, in a comfortable environment, $\Phi_0$=4 mm; $\Phi_0$ represents the diameter of the pupil after a change in the environment causes a change in the pupil diameter.

Thus came the following formula.

$$L_{perception}=g(\phi,\phi_0)*L_{device}=(\phi/\phi_0)^2*L_{device} \quad (4)$$

Further, ideally, the absolute standard brightness-grayscale curve for eye perception can be divided into three sections. Similarly, the applicable standard brightness-grayscale curve for eye perception is also divided into three sections. The grayscales of the absolute standard brightness-grayscale curve for eye perception are sub-divided with interpolation, such that the applicable standard brightness-grayscale curve for eye perception is obtained, thus the basic shape of the curve does not change. One section is a dark-view section, one section is a comfortable bright-view section, and one section is an ultra-bright section. The contrast sensitivity thresholds, or Weber-Fehniel coefficients ΔL/L=C, are different for each of these three sections.

In the limbic region, the brightness difference is required to become greater due to the decreased perception of the cells caused by proximity to the sensory limit of the optic cell. This is what should be paid special attention to when adjusting the brightness curve.

According to the results of physio-physical tests, the absolute standard brightness-grayscale curve for eye perception in a comfort zone was derived. Then, the absolute standard brightness-grayscale curve for eye perception in the comfort zone can be obtained according to the requirements of the Weber-Fehniel coefficient (the minimum threshold for contrast) in different regions of the eye.

$$L_{perception}=H(n) \quad (5)$$

where $$H(n)=\begin{cases} H_1(n),\ 0 \le n \le N_1 \text{(at dark – view section)} \\ H_2(n),\ N_1 < n \le N_2 \text{(at bright – view section)} \\ H_3(n),\ N_2 < n \le N_{max} \text{(at ultral – brightsection)} \end{cases} \quad (6)$$

The sectional curve of $L_{perception}$ is illustrated in an example as follows.

Refer to FIG. 1C, FIG. 1C is a diagram illustrating an actual-measured absolute standard brightness-grayscale curve for eye perception, where the horizontal coordinate is 1 g ($L_{perception}$) and the vertical coordinate is grayscale n. From FIG. 1C, it can be seen that the value of the change in brightness $\Delta L_{perception}$ perceived by the eye has the following approximate relationship with the value of the change in grayscale Δn.

$$\Delta n = k*\left(\frac{\Delta L_{perception}}{L_{perception}}\right) \quad (7)$$

When Δn=1, $$\left(\frac{\Delta L_{perception}}{L_{perception}}\right) = \frac{1}{k}.$$

According to Weber's law (i.e. $\Delta L_{perception}/L_{perception}$=constant), 1/k is a constant in the comfort zone of the eye, which is expressed as C. The functional expression of grayscale n can be measured several times as follows.

$$n=k*Ln(L_{perception})+C \quad (8)$$

Among them, $L_n(\ )$ denotes the natural logarithm, the logarithm with e serving as the base.

In fact, see FIG. 1C, 1/k is not a constant over the entire section, and Weber's law applies over a range from 1 to 1000 nit. In the range of brightness below 1 nit or above 1000 nit, k is small, i.e. 1/k is large, at over 2.6%. And in the range of 1~1000 nit, k is large.

It is understood that the above is a description of the absolute standard brightness-grayscale curve for eye perception, and the applicable standard brightness-grayscale curve for eye perception is derived only by further transformation and without further elaboration.

For conditions at the edge of pupil adjustment (e.g., where brightness is very low or high), the brightness $L_{perception}$ perceived by the eye is mainly positively correlated with the brightness $L_{device}$ of the display device due to the weakened pupil adjustment, which can be expressed by the following curve.

$$L_{perception}=c_1*L_{device}+c_2 \quad (9)$$

In addition, to achieve a reductive perception of the eye on the transmitted image, it is first required to ensure that all grayscales of the image can be displayed in the eye. That is, from the lowest to the highest brightness perceived, the various grayscales can be connected smoothly without steps in the perception of the eye.

For image transmission, it is also desirable that this data be as little as possible, so that the physical brightness differences for the various grayscales of the display device are as close as possible to those recognizable to the eye. In the comfort zone of the eye, it is followed according to Weber's Law.

$$\left(\frac{\Delta L_{device}}{L_{device}}\right) = C \quad (10)$$

where C is a constant, then the formula is given as follows.

$$L_{device}(n+1)=L_{device}(n)*(1+C) \quad (11)$$

$$\text{If } L_{device}(0)=L_{device\text{-}min} \quad (12)$$

Then $$L_{device}(n)=L_{device\text{-}min}*(1+C)^n \quad (13)$$

$$L_{device\text{-}max}=L_{device\text{-}min}*(1+C)^{n_{max}} \quad (14)$$

Thus, a formula is derived as follows.

$$n_{max} = \frac{Lg\left(\frac{L_{device-max}}{L_{device-min}}\right)}{Lg(1+C)} \quad (15)$$

where, $L_{device}(n)$ denotes the brightness of the display device when the grayscale is n, $L_{device}(n+1)$ denotes the brightness of the display device when the grayscale is n+1, Lg( ) denotes the logarithm with 10 as the base, $L_{device\text{-}max}$ is the maximum brightness value of the display device, $L_{device\text{-}min}$ is the minimum brightness value of the display device, $n_{max}$ is the maximum value of the grayscale of the display device. Therefore, the account of grayscales in the comfort zone should be at least greater than $n_{max}$.

For example, a normal display device has a display brightness from 0.3 nit to 300 nit with a constant C=3%, at which $n_{max}$=233. In this case, brightnesses displayed with 256 grayscales can already meet its display requirements.

Based on the above analysis, the following principles can be considered when the physical brightness-grayscale curve of a display device is set.

(1)

$$L_{device}=L_{perception}*(\Phi_0/\Phi)^2 \quad (16)$$

(2) The minimum brightness and maximum brightness perceived by the eye are determined according to the minimum brightness and maximum brightness of the display device.

(3) The minimum value of the required $n_{max}$ is determined based on the minimum brightness and the maximum brightness perceived by the eye.

(4) Special attention is paid to ensure sufficient brightness gradients in the dark-view section (<1 nit) and ultra-bright section (>1000 nit), otherwise it is easy to oversaturate at low and high grayscales.

(5) The lowest physical brightness achieved by the display device shall be the starting point of the lowest grayscale of the standard curve, and 0 brightness is not taken as the starting point of the standard curve.

(6) Other circumstances of practical application are taken into consideration.

Combining the above principles, the theoretical brightness value of the display device corresponding to each grayscale $L_{device}$ can be obtained according to the following formula.

1. When determining $L_{perception}=Y_1$ $(n_0,n,L_{device\text{-}max}, L_{device\text{-}min})$, $$L_{perception}=g(\Phi,\Phi_0)*Y_1(n_0,n,L_{device\text{-}max},L_{device\text{-}min}) \quad (17)$$

Since $Y_1(n)$ is an experimental curve, a more generalized formula can be expressed as follows.

$$L_{device}=Y_2(n_0,n,L_{device\text{-}max},L_{device\text{-}min},\Phi,\Phi_0) \quad (18)$$

where, $n_0$ denotes the intermediate factor.

$$L_{device\text{-}min}=Y_2(n_0,0,L_{device\text{-}max},L_{device\text{-}min},\Phi,\Phi_0) \text{ if } n=0 \quad (19)$$

$$L_{device\text{-}max}=Y_2(n_0,n_{max},L_{device\text{-}max},L_{device\text{-}min},\Phi,\Phi_0) \text{ if } n=n_{max} \quad (19)$$

And if $\Phi=\Phi_0$ (i.e., when the pupil diameter is unchanged), $L_{perception}=L_{device}$, at this time, $$L_{perception}=L_{device}=Y_2(n_0,n,L_{device\text{-}max},L_{device\text{-}min},\Phi_0,\Phi_0) \quad (21)$$

2. Further, when $L_{perception}$ is, ideally, a three-section curve, the corresponding $L_{device}$ is also a three-section curve.

$$L_{device}=\begin{cases} Y_3(n_0, n, L_{device-max}, L_{device-min}, \phi, \phi_0), 0 \le n \le N_1 (\text{at dark-view section}) \\ Y_4(n_0, n, L_{device-max}, L_{device-min}, \phi, \phi_0), N_1 < n \le N_2 (\text{at bright-view section}) \\ Y_5(n_0, n, L_{device-max}, L_{device-min}, \phi, \phi_0) N_2 < n \le N_{max} (\text{at ultra-bright section}) \end{cases} \quad (22)$$

Among them,

If n=0,

At the dark-view section:

$$L_{device\text{-}min1}=Y_3(n_0,0,L_{device\text{-}max},L_{device\text{-}min},\Phi,\Phi_0) \quad (23)$$

At the bright-view section:

$$L_{device\text{-}min2}=Y_4(n_0,0,L_{device\text{-}max},L_{device\text{-}min},\Phi,\Phi_0) \quad (24)$$

At the ultra-bright section:

$$L_{device\text{-}min3}=Y_5(n_0,0,L_{device\text{-}max},L_{device\text{-}min},\Phi,\Phi_0) \quad (25)$$

If $n=n_{max}$,

At the dark-view section:

$$L_{device\text{-}max1}=Y_3(n_0 n_{max},L_{device\text{-}max},L_{device\text{-}min},\Phi,\Phi_0) \quad (26)$$

At the bright-view section:

$$L_{device\text{-}max2}=Y_4(n_0 n_{max},L_{device\text{-}max},L_{device\text{-}min},\Phi,\Phi_0) \quad (27)$$

At the ultra-bright section:

$$L_{device\text{-}max3}=Y_5(n_0 n_{max},L_{device\text{-}max},L_{device\text{-}min},\Phi,\Phi_0) \quad (28)$$

And if $\Phi=\Phi_0$ (i.e., when the pupil diameter is unchanged), $L_{perception}=L_{device}$, then, $$L_{perception}=L_{device}=\begin{cases} Y_3(n_0, n, L_{device-max}, L_{device-min}, \phi, \phi_0), 0 \le n \le N_1 (\text{at dark-view section}) \\ Y_4(n_0, n, L_{device-max}, L_{device-min}, \phi, \phi_0), N_1 < n \le N_2 (\text{at bright-view section}) \\ Y_5(n_0, n, L_{device-max}, L_{device-min}, \phi, \phi_0) N_2 < n \le N_{max} (\text{at ultra-bright section}) \end{cases} \quad (29)$$

where, $L_{perception}$ can be a power function curve, logarithmic curve, perceptual quantization curve, etc., Y1( ), Y2( ), Y3( ), Y4( ), and Y5( ) denote gamma functions.

Among them, the gamma curve (shown below) is a power curve, which serves as the $L_{perception}$ in the bright-view section. Weber's law no longer applies if a wider area is to be displayed. Empirically, we consider areas with brightness ranging from 0 to 0.1 nit and brightness greater than 1000 nit, as non-comfort zones. As another implementation, the Dolby curve (PQ curve) is a perceptual quantization curve, which can also be used as an implementation of $L_{perception}$.

Specific implementations will be described in detail in subsequent implementation examples and embodiments.

Figure 2:
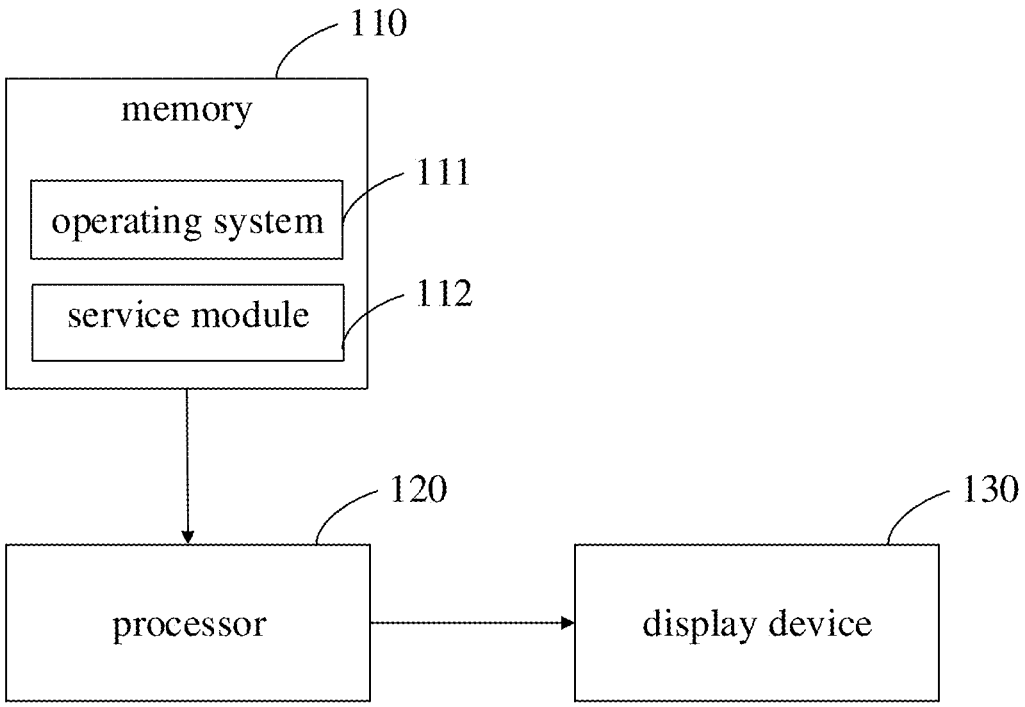
FIG. 2 is a block diagram illustrating an electronic device according to the embodiments of the present disclosure.

FIG. 2 is a block diagram illustrating an electronic device according to the embodiments of the present disclosure. The electronic device includes a memory 110, a processor 120, and a display device 130.

The memory 110 can be used for storing software programs and modules, such as the program instructions/modules corresponding to a method and a device for modulating a brightness-grayscale curve of a display device in the present embodiment. The processor 120 performs various functional applications and data processing by running software programs and modules stored in the memory 110, thus the method for modulating the brightness-grayscale curve of the display device of the present embodiment is realized.

The memory 110 may include high-speed random memory and may also include non-volatile memory, such as one or more magnetic storage devices, flash memory, or other non-volatile solid-state memory. Further, the software programs and modules in the above memory 110 may include operating system 111 and service modules 112. The operating system 111 may be, for example, LINUX, UNIX, WINDOWS, etc. The operating system 111 may include software components and/or drivers for management system tasks (e.g., memory management, storage device control, power management, etc.), which may communicate with each hardware or software component to provide an operating environment for other software components. The service module 112 is running on the operating system 111, and monitors the requests from the network through the network services of the operating system 111, and completes the corresponding data processing according to the requests.

The display device 130 may be used for displaying images. The display device 130 may include a two-dimensional display, a three-dimensional display, etc. Further, two-dimensional displays may also include CRT (Cathode Ray Tube) displays and LCD (Liquid Crystal Display) displays, etc, without limitation.

It is understood that the structure shown in FIG. 2 is illustrative. The electronic device may also include more or fewer components than those shown in FIG. 2, or have a different configuration than that shown in FIG. 2. The individual components shown in FIG. 2 can be implemented using hardware, software, or a combination thereof.

The method and device for modulating the brightness-grayscale curve of the display device according to the embodiments of the present disclosure will be described in more detail below in conjunction with the attached drawings.

According to the embodiments of the present disclosure, at first, theoretical brightness values of respective grayscales of the display device are obtained according to a maximum brightness value of the display device, a minimum brightness value of the display device, a maximum grayscale value of the display device, and a gamma parameter related to the display environment. Then the brightnesses of the display device under respective grayscales are modulated according to the theoretical brightness values corresponding to the respective grayscales of the display device. It should be understood that the maximum grayscale value of the display device reflects the ability of the display device to express the color depth, and the maximum and minimum brightness values of the display device reflect the ability of the display device to output maximum and minimum brightness.

Figure 3:
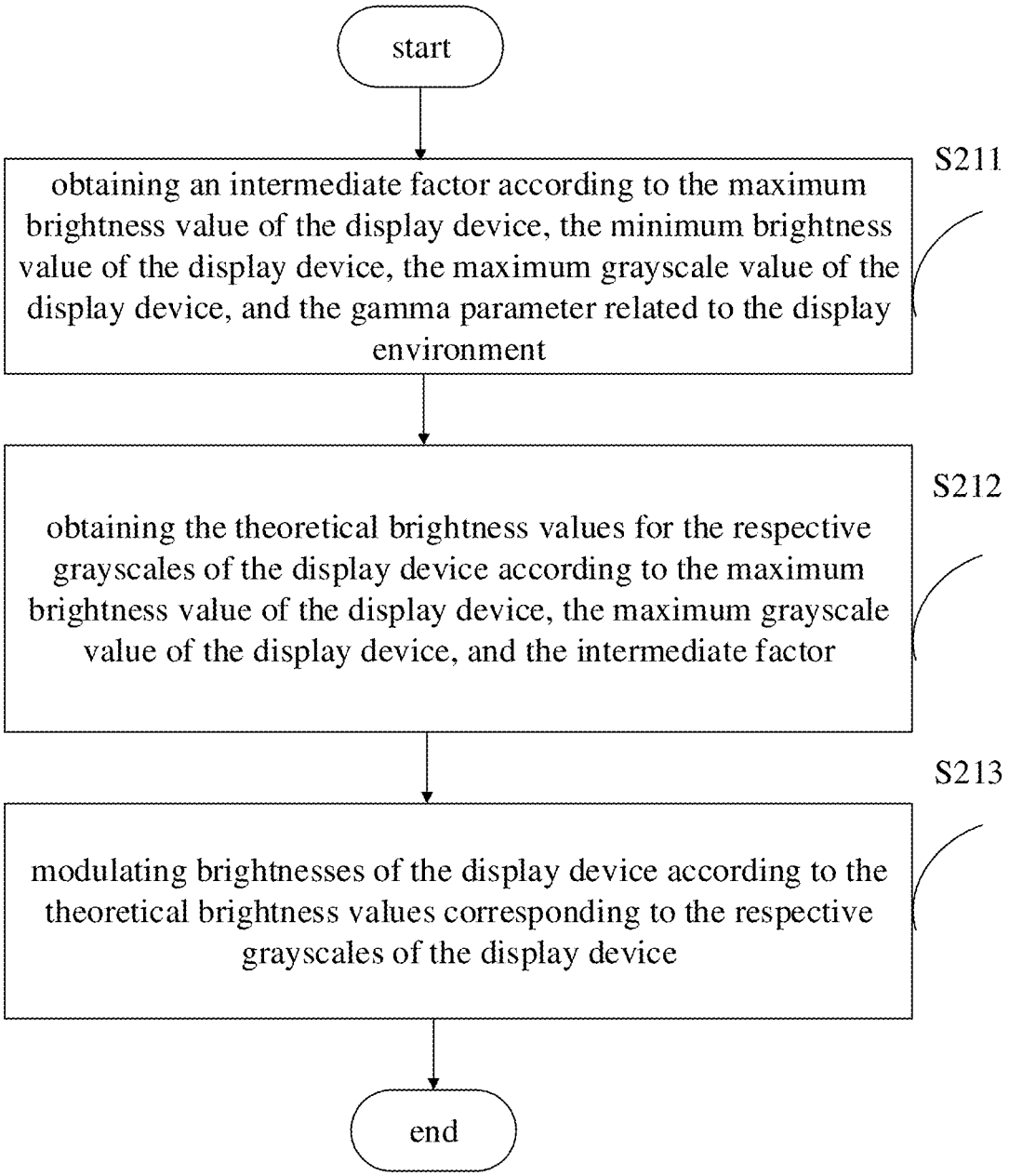
FIG. 3 is a flowchart illustrating a method for modulating a brightness-grayscale curve of a display device according to the embodiments of the present disclosure.

FIG. 3 is a flowchart illustrating a method for modulating a brightness-grayscale curve of a display device according to the embodiments of the present disclosure. Referring to FIG. 3, this embodiment depicts that an applicable standard brightness-grayscale curve for eye perception (corresponding to $L_{perception}(n)$) is determined as a gamma curve. The method includes the following steps.

At step S211, an intermediate factor is obtained according to a maximum brightness value of a display device, a minimum brightness value of the display device, a maximum grayscale value of the display device, and a gamma parameter related to the display environment.

As an embodiment, the intermediate factor of step S211 can be calculated according to the following formula.

$$n_0 = \frac{n_{max}}{\left(\frac{L_{device-max}}{L_{device-min}}\right)^{\frac{1}{\gamma}} - 1} \tag{30}$$

where, $L_{device-max}$ is the maximum brightness value of the display device, $L_{device-min}$ is the minimum brightness value of the display device, $n_{max}$ is the maximum grayscale value of the display device, $\gamma$ is the gamma parameter related to the display environment, and $n_0$ is the intermediate factor.

Among them, the values of $L_{device-max}$ and $L_{device-min}$ can be obtained by measuring. For example, $L_{device-max}$ can be measured when being given the maximum grayscale input, and $L_{device-min}$ can be measured when being given the minimum grayscale input. The values of $L_{device-max}$, $L_{device-min}$, and $n_{max}$ are determined after the display device to be modulated is manufactured. Specifically, the value range for $n_{max}$ can be, for example, 63, 125, 255, 511, 1023, etc., of course without limitation.

Understandably, the implementation of obtaining an intermediate factor is not limited to the above-mentioned formulas. An intermediate factor can also be obtained according to other formulas or the variations of the above-mentioned formulas.

Further, as an example, the gamma parameter can be in the range from 2.0 to 2.4. In another example, the gamma parameter can be in the range from 2.18 to 2.4. In another example, for example, the gamma parameter can be 1.8, 2.0, 2.1, 2.2, 2.3, 2.4, etc. By setting the value of the gamma parameter within this range, the display effect of the device is optimized.

Further, in consideration of the effect of an environmental factor on eye perception, as another example, the gamma parameter can be determined based on the value of the environmental factor.

Among these, the environmental factor may include a brightness value of the environment, etc. For example, it is possible to determine whether the current environment is a bright (office) environment or a dark (darkroom) environment, and so forth, according to the environmental factor.

As an example, when the value of the environmental factor belongs to a first environmental parameter range, the value of the gamma parameter belongs to a first gamma parameter range; when the value of the environmental factor belongs to a second environmental parameter range, the value of the gamma parameter belongs to a second gamma parameter range; wherein, the values in the first environmental parameter range are greater than the values in the second environmental parameter range, and the values in the first gamma parameter range are less than the values in the second gamma parameter range.

For example, if the value of the environmental factor is the brightness value of the environment, the value of the gamma parameter can be 2.2 if the brightness value of the environment belongs to the range of brightness value corresponding to a bright (office) environment, and the value of the gamma parameter can be 2.4 if the brightness value of the environment belongs to the range of brightness value corresponding to a dark (darkroom) environment. Of course, the given value is only an example, other values can be used, such as other values close to the given example value.

As a result, the gamma parameter is larger if the value of the environment factor is small (dark environment) and the gamma parameter is smaller if the value of the environment factor is large (bright environment). The display of the display device is further optimized by modulation in this way.

The above approach takes into consideration the influence of the environmental factor on eye perception, thus the problem is solved that modulation of the display device using the ideal gamma curve will cause the visible grayscale in a dimmed environment to be no longer distinguishable in a bright environment.

Of course, in addition to consideration of the effect of the environmental factor on the perception of the eye, it is also possible to consider the effect of other factors on the changes in the eye pupil. For example, Those factors include but not limited to, a factor related to the display device, and a factor related to the human body, etc.

Among them, the factor related to the display device may include at least one of the size of the screen of the display device, a brightness of the display device, a distance between the display device and the user. Specifically, the brightness of the display device can also include an average brightness in use, a maximum brightness, a minimum brightness of the display device, without limitations. It can be understood that, since the size of the display device screen and the distance between the display device and the human body may also affect the stereo angle of the display device in the eye, therefore, the factor related to the display device may also include the stereo angle of the display device in the eye.

In view that the change of the pupil is affected by at least one of the screen size of the display device, the brightness of the display device, the distance between the display device and the human body, these parameters are used as factors related to the display device, such that the modulation of the display device is more accurate.

Among them, the factor related to the human body may include the size of the pupil of the eye, etc.

As a result, the factor related to the human body is specified to the pupil size of the eye, so that the modulation of the display device by the gamma curve is more accurate, which can mitigate the effects of different display brightness.

Specifically, there are various ways to obtain the factors affecting the change of the eye pupil. For example, the brightness of the environment can be obtained from the light sensor. It is also possible to obtain a factor related to the display device by measurement devices or by reading the screen size of the display device directly from the display device. It is also possible to measure the pupil size of the eye with an eye measurement device. But the factors are not limited to these. With the consideration of the above-mentioned factors affecting change of the eye pupil, the gamma parameter can be further modulated to further optimize the modulation results.

Returning to FIG. 3, the method for modulating the brightness-grayscale curve of the display device shown in FIG. 3 further includes step S212. At step S212, the theoretical brightness values corresponding to respective grayscales of the display device are obtained according to a maximum brightness value of the display device, a maximum grayscale value of the display device, an intermediate factor and the respective grayscales of the display device.

As an embodiment, Step S212 can be calculated according to the following formula.

$$L_{device}(n) = L_{device-max} * \left(\frac{n + n_0}{n_{max} + n_0}\right)^{\gamma} \tag{31}$$

where $L_{device-max}$ is the maximum brightness of the display device, $n_{max}$ is the maximum grayscale value of the display device, $n_0$ is the intermediate factor, n is each grayscale of the display device, $L_{device}(n)$ is a theoretical brightness value corresponding to the grayscale n of the display device, and γ is the gamma parameter related to the display environment.

Specifically, the values of $L_{device-max}$ and $L_{device-min}$ can be obtained by measurement. The range of $n_{max}$ can be, for example, 63, 125, 255, 511, 1023, etc. That is, the value of $n_{max}$ can be the power of 2 minus 1, of course without limitation. The value of $n_{max}$ depends on the brightness difference between two adjacent grayscales. The value of $n_{max}$ should remain less than or close to the minimum brightness difference perceivable to the eye, and the value of $n_{max}$ should be as large as possible to reduce the amount of image data transmitted. As an implementation, the value of $n_{max}$ can be 255 for a medium-size, high brightness display device, and the value of $n_{max}$ can be 1023 for a higher brightness display device.

At step S211, the solution yields no. Thus, when the individual grayscale n of the display device is determined, the theoretical brightness value $L_{device}(n)$ corresponding to the individual grayscale n of the corresponding display device can be derived. By the above formula, a quantifiable standard is proposed reasonably and executable to fill the gap of quantifiable conversion control standard in the field of liquid crystal display.

It can be understood that the implementation of obtaining the theoretical brightness value corresponding to each grayscale of the display device is not limited to the above formula. The theoretical brightness value can also be obtained based on other formulas or variations of the above formula.

Returning to FIG. 3, the method for modulating the brightness-grayscale curve of the display device shown in FIG. 3 further includes step S213. At step S213, a brightness of the display device is modulated according to the theoretical brightness value corresponding to each grayscale of the display device.

Figure 4:
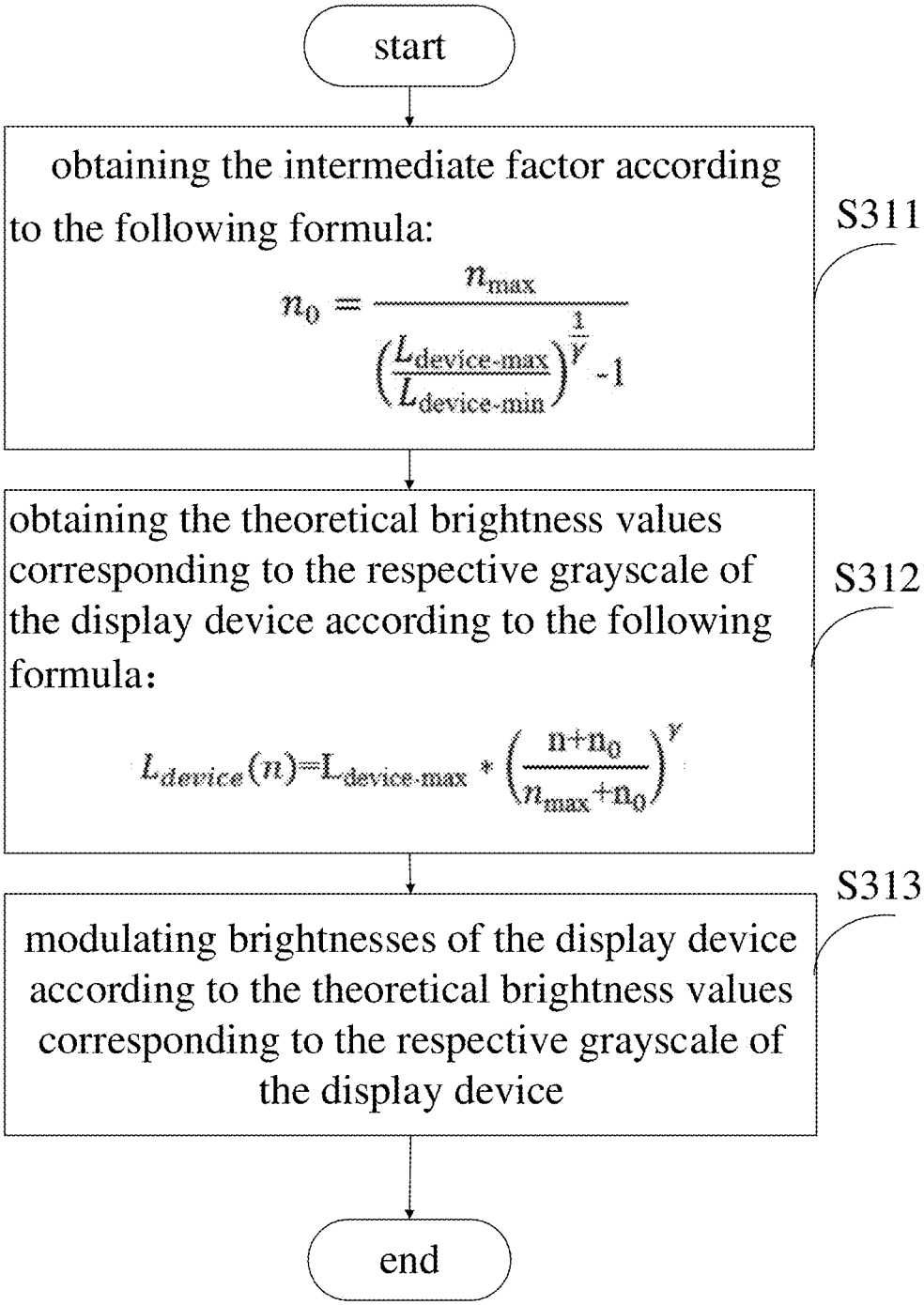
FIG. 4 is a flowchart illustrating another method for modulating a brightness-grayscale curve of a display device according to the embodiments of the present disclosure.

Referring to FIG. 4, an embodiment of a method for modulating a brightness-grayscale curve of a display device is given in FIG. 4.

At step S311, an intermediate factor is determined according to the following formula.

$$n_0 = \frac{n_{max}}{\left(\frac{L_{device-max}}{L_{device-min}}\right)^{\frac{1}{\gamma}} - 1}$$

where $L_{device-max}$ is the maximum brightness value of the display device, $L_{device-min}$ is the minimum brightness value of the display device, $n_{max}$ is the maximum grayscale value of the display device, γ is the gamma parameter related to the display environment, and $n_0$ is the intermediate factor.

At step S312, the theoretical brightness values corresponding to respective grayscales of the display device are obtained according to the following formula.

$$L_{device}(n) = L_{device-max} * \left(\frac{n + n_0}{n_{max} + n_0}\right)^{\gamma}$$

where $L_{device-max}$ is the maximum brightness of the display device, $n_{max}$ is the maximum grayscale value of the display device, $n_0$ is the intermediate factor, n is each grayscale of the display device, $L_{device}(n)$ is a theoretical brightness value corresponding to the grayscale n of the display device, and γ is the gamma parameter related to the display environment.

At step S313, a brightness of the display device is modulated according to the theoretical brightness values corresponding to the respective grayscales of the display device. For example, for each grayscale, the output brightness of the display device is adjusted to a theoretical brightness value corresponding to that grayscale, or to a brightness value which differs from the theoretical brightness value by a brightness difference within a predetermined error range.

Five different specific examples are given below to illustrate how to obtain the theoretical brightness values corresponding to respective grayscales of the display device.

Example 1

For liquid crystal display devices (such as SDR liquid crystal display devices), if the brightness value corresponding to the minimum grayscale value of the display device is 0, then according to the gamma curve of the CRT display, the selected gamma parameter γ related to the display environment is 2.2 in case that the application scene is a general office environment (i.e., bright environment, for example, environment illumination is 200 lx, lighting power density is 7 W/m$^2$, and the maximum brightness value of the display device is 250 nit), and the intermediate factor no is calculated as 0 according to the formula. And, the following formula is calculated.

$$L_{device}(n) = L_{device-max} * \left(\frac{n}{255}\right)^{2.2}$$

where $L_{device}(n)$ is the theoretical brightness value corresponding to the grayscale n of the display device, $L_{device-max}$ is the maximum brightness value of the display device, n is each grayscale of the display device.

Example 2

For liquid crystal display devices (such as SDR liquid crystal display devices), if the brightness value corresponding to the minimum grayscale value of the display device is not 0 but $L_{device-min}$, then according to the gamma curve of the CRT display, the selected gamma parameter γ related to the display environment is 2.2 in case that the application scene is a general office environment (i.e., bright environment, for example, the maximum brightness value of the display device is 250 nit, environment illumination is 200 lx, lighting power density is 7 W/m$^2$, and the maximum grayscale value of the display device is 255). Then, the following formula is calculated.

$$n_0 = \frac{n_{max}}{\left(\frac{L_{device-max}}{L_{device-min}}\right)^{\frac{1}{\gamma}} - 1}$$

$$L_{device}(n) = L_{device-max} * \left(\frac{n + n_0}{255 + n_0}\right)^{2.2}$$

$$L_{device-min} = L_{device-max} * \left(\frac{n_0}{255 + n_0}\right)^{2.2}$$

where $L_{device}(n)$ is a theoretical brightness value corresponding to the grayscale n of the display device, $L_{device-max}$ is the maximum brightness value of the display device, n is each grayscale of the display device, $n_0$ is the intermediate factor, $L_{device-min}$ is the minimum brightness value of the display device, $n_{max}$ is the maximum grayscale value of the display device.

Example 3

For liquid crystal display devices (such as SDR liquid crystal display devices), if the brightness value corresponding to the minimum grayscale value of the display device is not 0 but $L_{device-min}$, then according to the gamma curve of the CRT display, the selected gamma parameter γ related to the display environment is 2.4 in case that the application scene is a professional darkroom/cinema environment (i.e., dimmed environment, for example, the maximum brightness value of the display device is 250 nit, environment illumination is 5 lx, and the maximum grayscale value of the display device is 255). Then, the following formula is calculated.

$$n_0 = \frac{n_{max}}{\left(\frac{L_{device-max}}{L_{device-min}}\right)^{\frac{1}{\gamma}} - 1}$$

$$L_{device}(n) = L_{device-max} * \left(\frac{n + n_0}{255 + n_0}\right)^{2.4}$$

$$L_{device-min} = L_{device-max} * \left(\frac{n_0}{255 + n_0}\right)^{2.4}$$

where $L_{device}(n)$ is the theoretical brightness value corresponding to the grayscale n of the display device, $L_{device-max}$ is the maximum brightness value of the display device, n is each grayscale of the display device, $n_0$ is the intermediate factor, $L_{device-min}$ is the minimum brightness value of the display device, $n_{max}$ is the maximum grayscale value of the display device.

Example 4

For liquid crystal display devices (such as SDR liquid crystal display devices), if the brightness value corresponding to the minimum grayscale value of the display device is not 0 but $L_{device-min}$, then according to the gamma curve of the CRT display, the selected gamma parameter γ related to the display environment is 2.18 in case that the application scene is a general office environment (i.e., bright environment, for example, environment illumination is 55 lx, the maximum brightness value of the display device is 250 nit, the grayscale $L_{127}$ is set to 55 nit for the most comfortable visual experience, and the maximum grayscale value of the display device is 255), then. Then, the following formula is calculated.

$$n_0 = \frac{n_{max}}{\left(\frac{L_{device-max}}{L_{device-min}}\right)^{\frac{1}{\gamma}} - 1}$$

$$L_{device}(n) = L_{device-max} * \left(\frac{n + n_0}{255 + n_0}\right)^{\gamma}$$

$$L_{device-min} = L_{device-max} * \left(\frac{n_0}{255 + n_0}\right)^{\gamma}$$

$$L_{device}(127)=55$$

where $L_{device}(n)$ is the theoretical brightness value corresponding to the grayscale n of the display device, $L_{device-max}$ is the maximum brightness value of the display device, n is each grayscale of the display device, $n_0$ is the intermediate factor, $L_{device-min}$ is the minimum brightness value of the display device, $n_{max}$ is the maximum grayscale value of the display device. Of course, the calculations can also be performed according to the absolute standard brightness-grayscale curve for eye perception.

Example 5

For liquid crystal display devices (such as LCD liquid crystal display devices), if the brightness value corresponding to the minimum grayscale value of the display device is not 0 but $L_{device-min}$, then according to the gamma curve of the LCD display, in case that the application scenario is cinema mode and it is assumed that the pupil diameter of the eye in the comfortable environment brightness is $\Phi_0$ and the pupil diameter of the eye in the cinema mode is $\Phi$, the effect of the pupil diameter on the brightness of the eye perception is reflected by setting the gamma parameter $\gamma$ related to the display environment. Because in the comfortable environment $\gamma$ is 2.2 and the exponential value of the CRT photoelectric conversion function is 2.4, so here $\gamma$ can be 2.4. Then, the following formula is calculated.

$$L_{device}(n) = L_{device-max} * \left(\frac{n + n_0}{255 + n_0}\right)^{2.4}$$

$$L_{device-min} = L_{device-max} * \left(\frac{n_0}{255 + n_0}\right)^{2.4}$$

where $L_{device}$ (n) is the theoretical brightness value corresponding to the grayscale n of the display device, $L_{device-max}$ is the maximum brightness value of the display device, n is each grayscale of the display device, $n_0$ is the intermediate factor, $L_{device-min}$ is the minimum brightness value of the display device, $n_{max}$ is the maximum grayscale value of the display device.

By the method for modulating a brightness-grayscale curve of a display device according to the embodiments of present disclosure, an intermediate factor is obtained according to the maximum brightness value of the display device, the minimum brightness value of the display device, the maximum grayscale value of the display device, and the gamma parameter related to the display environment. And further, the theoretical brightness values corresponding to respective grayscales of the display device are obtained according to a maximum brightness value of the display device, a maximum grayscale value of the display device, an intermediate factor and the respective grayscale of the display device. The problems of low grayscale details, backlighting, high grayscale saturation, and transition-color unevenness and the like caused by modulation of the display device using the ideal gamma curve are solved. By considering the effect of environmental factors on eye perception, the problem is solved that modulating a display device with an ideal gamma curve would cause the visible grayscale in a dimmed session to be no longer distinguishable in a bright environment. And a quantifiable standard is provided, which fills a gap for standards in the display field.

Figure 5:
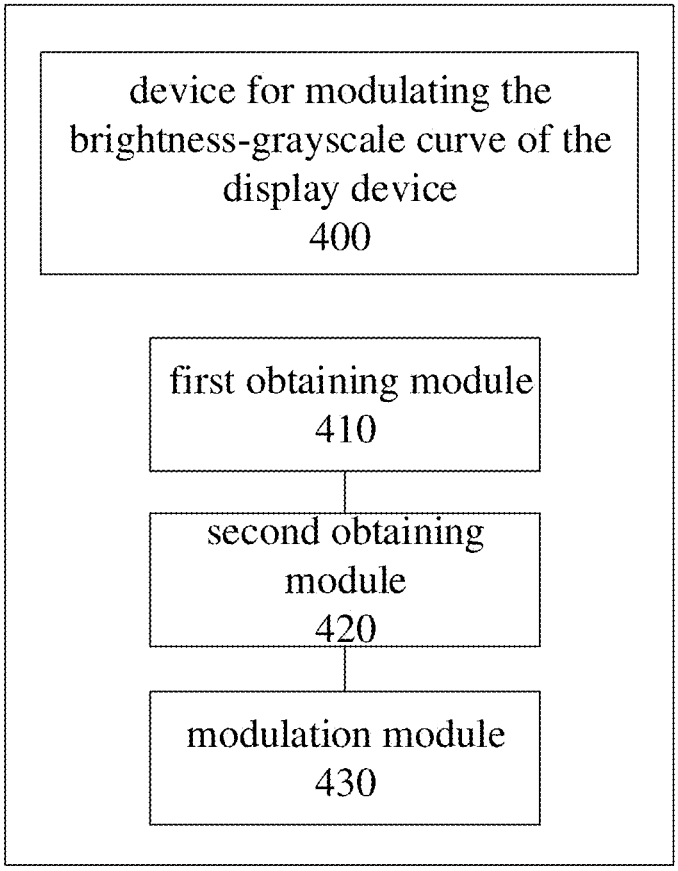
FIG. 5 is a functional block diagram illustrating a device for modulating a brightness-grayscale curve of a display device according to the embodiments of the present disclosure.

FIG. 5 is a functional block diagram illustrating a device 400 for modulating a brightness-grayscale curve of a display device according to the embodiments of the present disclosure. If the applicable standard brightness-grayscale curve for eye perception in comfort (corresponding to $L_{perception}$ (n)) is determined as a gamma curve, the method for modulating according to the embodiments of the present disclosure is executed by the device for modulating according to the embodiments of the present disclosure.

The device 400 for modulating the brightness-grayscale curve of the display device is operated in an electronic terminal. The device 400 for modulating the brightness-grayscale curve of the display device may include a first obtaining module 410, a second obtaining module 420, and a modulation module 430.

The first obtaining module 410 is configured for obtaining an intermediate factor according to the maximum brightness value of the display device, the minimum brightness value of the display device, the maximum grayscale value of the display device, and the gamma parameter related to the display environment.

As an example, the first obtaining module 410 is configured for further obtaining no.

$$n_0 = \frac{n_{max}}{\left(\frac{L_{device-max}}{L_{device-min}}\right)^{\frac{1}{\gamma}} - 1}$$

where $L_{device-max}$ is the maximum brightness value of the display device, $L_{device-min}$ is the minimum brightness value of the display device, $n_{max}$ is the maximum grayscale value of the display device, $\gamma$ is the gamma parameter related to the display environment, and $n_0$ is the intermediate factor.

Further, as an example, the gamma parameter is in the range from 2.0 to 2.4.

Further, as an example, the gamma parameter is determined based on the value of an environmental factor.

Specifically, as an example, the determining gamma parameter based on the value of an environmental factor includes: when the value of the environmental factor belongs to a first environmental parameter range, the value of the gamma parameter belongs to a first gamma parameter range; when the value of the environmental factor belongs to a second environmental parameter range, the value of the gamma parameter belongs to a second gamma parameter range; wherein, the values in the first environmental parameter range are greater than the values in the second environmental parameter range, and the values in the first gamma parameter range are less than the values in the second gamma parameter range.

The second module 420 is configured for obtaining the theoretical brightness values for respective grayscales of the display device according to the maximum brightness value of the display device, the maximum grayscale value of the display device, the intermediate factor, and the respective grayscales of the display device.

As an example, the second module 420 is configured for further obtaining $L_{device}$(n).

$$L_{device}(n) = L_{device-max} * \left(\frac{n + n_0}{n_{max} + n_0}\right)^{\gamma}$$

where $L_{device-max}$ is the maximum brightness value of the display device, $n_{max}$ is the maximum grayscale value of the display device, $n_0$ is the intermediate factor, n is each grayscale of the display device, $L_{device}$(n) is a theoretical brightness value corresponding to the grayscale n of the display device, and $\gamma$ is the gamma parameter related to the display environment.

The modulation module 430 is configured for modulating brightnesses of the display device according to the theoretical brightness values corresponding to respective grayscales of the display device.

As an example, the modulation module is configured for modulating the brightnesses of the display device according to an eye pupil change factor and the theoretical brightness values corresponding to respective grayscales of the display device.

Specifically, the eye pupil change factor comprises a value corresponding to a ratio of a diameter of the eye pupil at current environment brightness to a diameter of the eye pupil at predefined environment brightness.

By the device for modulating a brightness-grayscale curve of a display device according to the embodiments of the present disclosure, an intermediate factor is obtained according to the maximum brightness value of the display device, the minimum brightness value of the display device, the maximum grayscale value of the display device, and the gamma parameter related to the display environment. And further, the theoretical brightness values corresponding to respective grayscales of the display device are obtained according to a maximum brightness value of the display device, a maximum grayscale value of the display device, an intermediate factor, and the respective grayscales of the display device. The problems of low grayscale details, backlighting, high grayscale saturation, and transition-color unevenness and the like caused by modulation of the display device using the ideal gamma curve are solved. By considering the effect of environmental factors on eye perception, the problem is solved that modulating a display device with an ideal gamma curve would cause the visible grayscale in a dimmed session to be no longer distinguishable in a bright environment. And a quantifiable standard is provided, which fills a gap for standards in the display field.

The above modules can be implemented not only by software code, but also by hardware such as IC chips.

Figure 6:
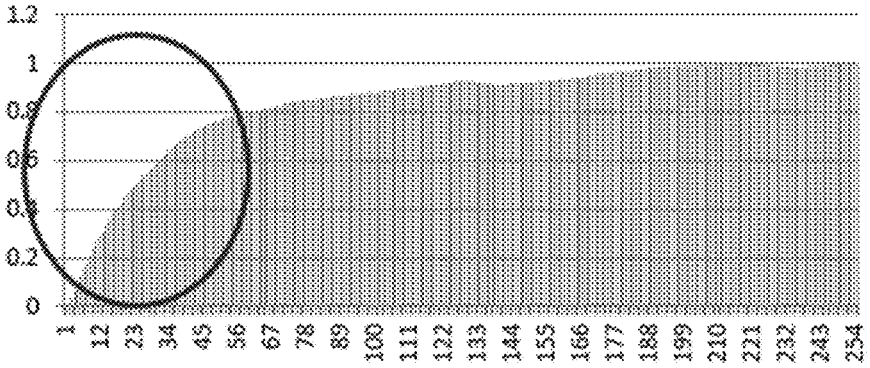
FIG. 6 is a graph illustrating the ratios of the brightness values corresponding to respective grayscales of a display device modulated by a conventional gamma curve to the brightness values corresponding to the respective grayscales of the actual-measured modulated display device.

Referring to FIG. 6, FIG. 6 is a graph illustrating the ratios of brightness values corresponding to respective grayscale of an ideal display device modulated by a conventional gamma curve to the actual-measured brightness values corresponding to the respective grayscales of the modulated display device. Among them, a conventional gamma curve is as follows.

$$\frac{L_{device}(n)}{L_{device-max}} = \left(\frac{n}{255}\right)^{2.2}$$

After modulation by conventional gamma curve, it happens that, when the grayscale is low, the ratio of the brightness value corresponding to the grayscale in the display device (i.e., the theoretical brightness value corresponding to the grayscale in the display device obtained by conventional gamma curve) to the actual measured brightness value corresponding to the grayscale in the modulated display device is a small value. If no adjustment is made and an image is displayed directly with the display device, there is insufficient brightness difference for the low grayscale of the display device, the dark details are not obvious, and the shadow area of the display device is dark. The entire image is as if taken in reverse light.

To overcome this problem, a gamma correction is usually performed. For example, data transformations can be used to replace low brightness values with higher brightness values (i.e., actually, some lower physical grayscales are discarded). By recursion, the discarded grayscales are usually translated to the high brightness grayscale, so that the detail difference in the highlights of the picture will disappear. If the discarded grayscales are translated to medium brightness, some medium grayscale will be lost. This may cause color transitions in steps if a full-color gamut is tested on the display device. The effect on the skin is that the localized skin difference disappears, the skin looks like wax, and the highlighted areas become white. It is also possible to use FRC (Frame Rate Conversion) to display high brightness grayscale and low brightness grayscale in rotation to achieve the visual effect of increasing the brightness of the low grayscale. But it is difficult to reconcile the following problems: on which grayscale the rotation is performed? how many sub-pixels are related in the rotation? what is the periodicity of the rotation? will there be flicker, mesh, or ripples after the rotation?

Figure 7:
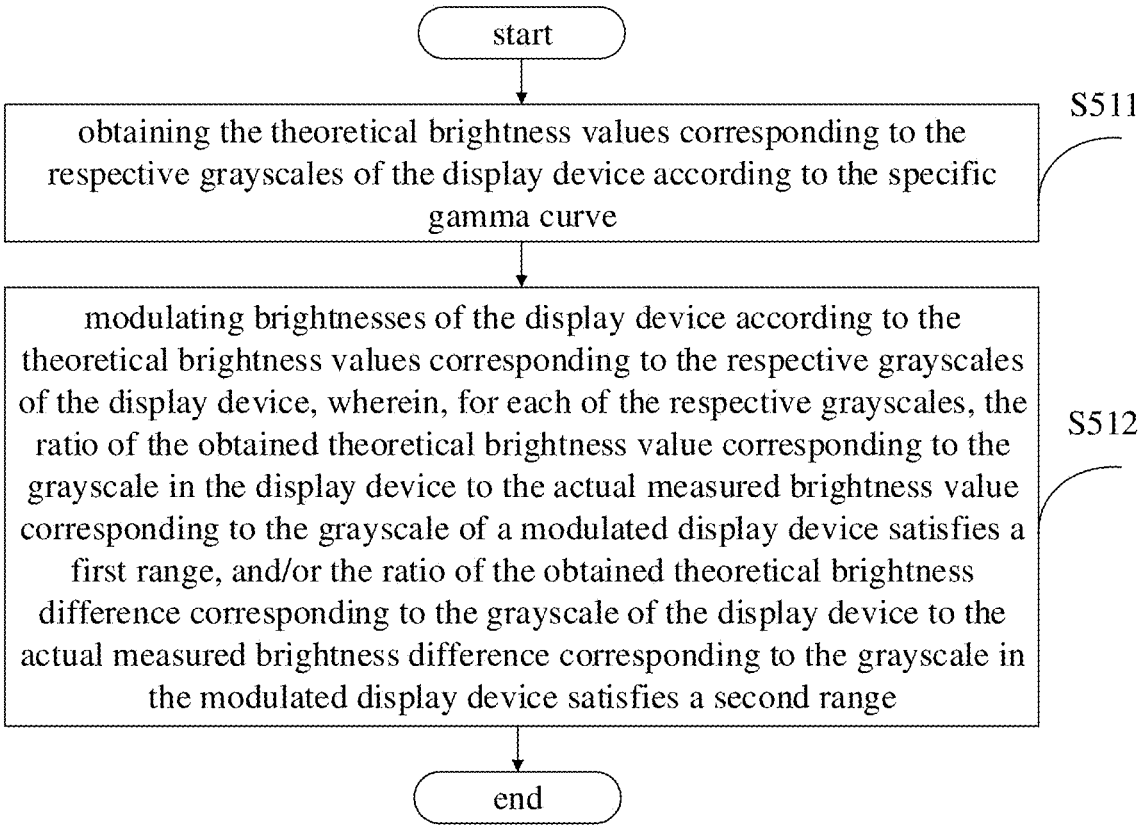
FIG. 7 is a flowchart illustrating a method for modulating a brightness-grayscale curve of a display device according to the embodiments of the present disclosure.

To solve the above problems, referring to FIG. 7, FIG. 7 is a flowchart illustrating a method for modulating a brightness-grayscale curve of a display device according to the embodiments of the present disclosure. If the applicable standard brightness-grayscale curve for eye perception in comfort (corresponding to $L_{perception}(n)$) is a specific gamma curve, the method for modulating includes the following steps.

At step S511, the theoretical brightness values for respective grayscales in the display device are obtained according to a specific gamma curve.

As an example, the specific gamma curve includes the following.

$$L_{device}(n) = L_{device-max} * \left(\frac{n+n_0}{n_{max}+n_0}\right)^{\gamma}$$

$$n_0 = \frac{n_{max}}{\left(\frac{L_{device-max}}{L_{device-min}}\right)^{\frac{1}{\gamma}} - 1}$$

where $L_{device-max}$ is the maximum brightness value of the display device, $L_{device-min}$ is the minimum brightness value of the display device, $n_{max}$ is the maximum grayscale value of the display device, $n_0$ is the intermediate factor, n is each grayscale of the display device, $L_{device}(n)$ is a theoretical brightness value corresponding to the grayscale n of the display device, γ is the gamma parameter related to the display environment.

Further, as an example, the gamma parameter is in the range from 2.0 to 2.4.

As another example, the gamma parameter is determined based on the value of an environmental factor.

Specifically, the determining gamma parameter based on the value of an environmental factor includes: when the value of the environmental factor belongs to a first environmental parameter range, the value of the gamma parameter belongs to a first gamma parameter range; when the value of the environmental factor belongs to a second environmental parameter range, the value of the gamma parameter belongs to a second gamma parameter range; wherein, the values in the first environmental parameter range are greater than the values in the second environmental parameter range, and the values in the first gamma parameter range are less than the values in the second gamma parameter range.

For a further description of the specific gamma curve and corresponding gamma parameters, reference can be made to the description in the above-mentioned embodiment of this application, which is not repeated herein.

At step S512, brightnesses of the display device are modulated according to the theoretical brightness values corresponding to respective grayscales of the display device, wherein for each of the respective grayscales, the ratio of the obtained theoretical brightness value corresponding to the grayscale in the display device to the actual measured brightness value corresponding to the grayscale of the modulated display device satisfies a first range, and/or the ratio of the obtained theoretical brightness difference corresponding to the grayscale of the display device to the actual measured brightness difference corresponding to the grayscale in the modulated display device satisfies a second range.

Among them, the ratio of the obtained theoretical brightness value corresponding to each grayscale in the display device to the actual measured brightness value corresponding to the grayscale of the modulated display device is calculated according to a formula of $$\frac{L_{device}(n)}{L_{measure}(n)},$$

of course, the calculation method is not so limited.

Among them, the ratio of the obtained theoretical brightness difference corresponding to each grayscale of the display device to the actual-measured brightness difference corresponding to the grayscale in the modulated display device is calculated according to a formula of $$\frac{L_{device}(n) - L_{device}(n-1)}{L_{measure}(n) - L_{measure}(n-1)},$$

of course, the calculation method is not so limited.

As an example, modulating brightnesses of the display device according to the theoretical brightness values corresponding to the respective grayscales of the display device includes modulating the brightnesses of the display device according to an eye pupil change factor and the theoretical brightness value corresponding to the respective grayscales of the display device.

Specifically, the eye pupil change factor comprises a value corresponding to a ratio of a diameter of the eye pupil at current environment brightness to a diameter of the eye pupil at predefined environment brightness.

As an example, the first range may include, of course, without limitation, 1−15% to 1+15%, or a smaller range, e.g., 1−10% to 1+10%, 1−8% to 1+8%, 1−6% to 1+6%, etc.; or a larger range, e.g., 1−15% to 1+15%, 1−18% to 1+18%, 1−20% to 1+20%, etc.

Figure 8:
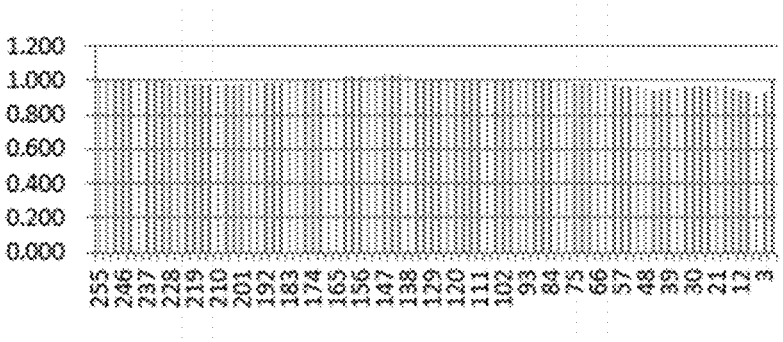
FIG. 8 is a graph illustrating the ratios of the obtained theoretical brightness values corresponding to respective grayscales in a display device, which is modulated by the method for modulating brightness-grayscale curve of the display device according to the embodiments of the present disclosure, to brightness values corresponding to the respective grayscales in the actual-measured modulated display device.

Referring to FIG. 8, FIG. 8 is a graph illustrating the ratio of the obtained theoretical brightness value corresponding to each grayscale in a display device, which is modulated by the method for modulating brightness-grayscale curve of the display device according to the embodiments of the present disclosure, to brightness value corresponding to the grayscale in the actual-measured modulated display device.

It can be understood that the horizontal axis from 0 to 255 in FIG. 8 is the range of values (not fully shown).

Thus, the ratio of the obtained theoretical brightness value corresponding to each grayscale in the display device to the actual measured brightness value corresponding to the grayscale of the modulated display device can be from 0.88 to 1.03.

By making the ratio of the obtained theoretical brightness value corresponding to each grayscale in the display device to the actual measured brightness value corresponding to the grayscale of the modulated display device to satisfy a first range, the deviation from the obtained theoretical brightness value corresponding to each grayscale in the display device to the actual measured brightness value corresponding to the grayscale of the modulated display device is a smaller value. This makes the theoretical brightness value of each grayscale in the display device obtained by calculation closer to the actual measured brightness value of the grayscale in the modulated display device, which makes the modulation effect better.

As an example, the second range includes, of course without limitation, 1−30% to 1+30%. It can be smaller, e.g., 1−20% to 1+20%, 1−15% to 1+15%, 1−15% to 1+15%, etc.; or it can be larger, e.g., 1−26% to 1+26%, 1−28% to 1+28%, 1−30% to 1+30%, etc.

Figure 9:
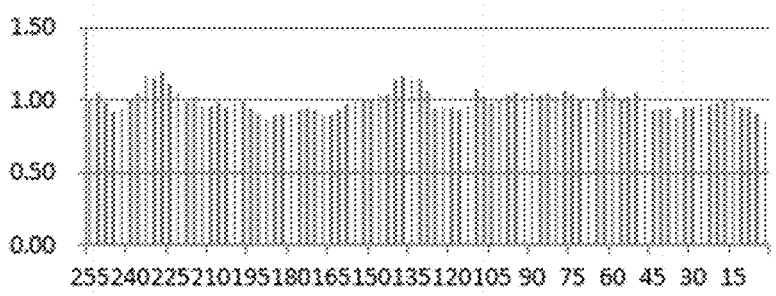
FIG. 9 is a graph illustrating the ratios of the obtained brightness differences corresponding to respective grayscales in a display device, which is modulated by the method for modulating the brightness-grayscale curve of the display device according to the embodiments of the present disclosure, to the brightness differences corresponding to the respective grayscales in the actual-measured modulated display device.

Referring to FIG. 9, FIG. 9 is a graph illustrating the ratio of the obtained brightness difference corresponding to each grayscale in a display device, which is modulated by the method for modulating the brightness-grayscale curve of the display device according to the embodiments of the present disclosure, to brightness difference corresponding to the grayscale in the actual-measured modulated display device. Among them, the horizontal axis is the grayscale of the display device, and the vertical axis is the ratio of the obtained brightness difference corresponding to each grayscale of the display device to the actual measured brightness difference corresponding to the grayscale in the modulated display device. It can be understood that the horizontal axis in FIG. 9 is the range from 0 to 255 (not fully shown).

Thus, the ratio of the obtained brightness difference corresponding to each grayscale of the display device to the actual measured brightness difference corresponding to the grayscale in the modulated display device is from 0.75 to 1.2.

By making the ratio of the obtained theoretical brightness difference corresponding to each grayscale of the display device to the actual measured brightness difference corresponding to the grayscale in the modulated display device satisfy the second range, the color fluctuation of the modulated display device is smaller and the transition of color is smoother.

As an example, a standard deviation between the obtained theoretical brightness values corresponding to the respective grayscales of the display device and the actual measured brightness values corresponding to the respective grayscales of the modulated display device satisfies a third range, or the maximum deviation between the obtained theoretical brightness values corresponding to the respective grayscales of the display device and the actual measured brightness values corresponding to the respective grayscales of the modulated display device satisfies a fourth range.

Among them, the standard deviation between the obtained theoretical brightness values corresponding to the respective grayscales of the display device and the actual measured brightness values corresponding to the respective grayscales of the modulated display device can be calculated as the following formula.

$$\sigma = \sqrt{\frac{1}{n_{max}} \sum_{n=1}^{n_{max}} \left( \frac{L_{device}(n) - L_{measure}(n)}{L_{device}(n)} \right)^2} \tag{32}$$

where $L_{device}(n)$ is a theoretical brightness value corresponding to the grayscale n of the display device, $n_{max}$ is the maximum grayscale value of the display device, n is each grayscale of the display device, $L_{measure}$ (n) is an actual measured brightness value corresponding to the grayscale n of the modulated display device.

The maximum deviation between the obtained theoretical brightness values corresponding to the respective grayscales of the display device and the actual measured brightness values corresponding to the respective grayscales of the modulated display device can be calculated as the following formula.

$$\mathrm{MAX} = \max\left\{\left|\frac{L_{device}(0)}{L_{measure}(0)} - 1\right|, \left|\frac{L_{device}(1)}{L_{measure}(1)} - 1\right|, \ldots, \left|\frac{L_{device}(n)}{L_{measure}(n)} - 1\right|\right\} \quad (33)$$

Of course, the method for calculating the maximum deviation between the obtained theoretical brightness values corresponding to respective grayscales of the display device and the actual measured brightness values corresponding to the respective grayscales of the modulated display device is not limited to this.

As an example, the standard deviation between the obtained theoretical brightness values corresponding to respective grayscales of the display device and the actual measured brightness values corresponding to the respective grayscales of the modulated display device can be 2.4%, and the maximum deviation between the obtained theoretical brightness values corresponding to respective grayscales of the display device and the actual measured brightness values corresponding to the respective grayscales of the modulated display device can be less than 11%.

As an example, the standard deviation between the obtained theoretical brightness values corresponding to respective grayscales of the display device and the actual measured brightness values corresponding to the respective grayscales of the modulated display device satisfies a fifth range, or the maximum deviation between the obtained theoretical brightness values corresponding to respective grayscales of the display device and the actual measured brightness values corresponding to the respective grayscales of the modulated display device satisfies a sixth range.

Among them, the standard deviation between the obtained theoretical brightness values corresponding to respective grayscales of the display device and the actual measured brightness values corresponding to the respective grayscales of the modulated display device can be calculated as the following formula.

$$\sigma = \sqrt{\frac{1}{n_{max}} \sum_{n=2}^{n_{max}} \left(\frac{[L_{device}(n) - L_{device}(n-1)] - [L_{measure}(n) - L_{measure}(n-1)]}{[L_{device}(n) - L_{device}(n-1)]}\right)^2} \quad (34)$$

where $L_{device}(n)$ is a theoretical brightness value corresponding to the grayscale n of the display device, $n_{max}$ is the maximum grayscale value of the display device, n is each grayscale of the display device, $L_{measure}(n)$ is an actual measured brightness value corresponding to the grayscale n of the modulated display device.

The maximum deviation between the obtained theoretical brightness values corresponding to the respective grayscales of the display device and the actual measured brightness values corresponding to the respective grayscales of the modulated display device can be calculated as the following formula.

$$\mathrm{MAX} = \max\left\{\left|\frac{\Delta L_{device}(0)}{\Delta L_{measure}(0)} - 1\right|, \left|\frac{\Delta L_{device}(1)}{\Delta L_{measure}(1)} - 1\right|, \ldots, \left|\frac{\Delta L_{device}(n)}{\Delta L_{measure}(n)} - 1\right|\right\} \quad (35)$$

Of course, the method for calculating the maximum deviation between the obtained theoretical brightness values corresponding to respective grayscales of the display device and the actual measured brightness values corresponding to the respective grayscales of the modulated display device is not so limited.

As an example, the standard deviation between the obtained theoretical brightness values corresponding to respective grayscales of the display device and the actual measured brightness values corresponding to the respective grayscales of the modulated display device can be 7.3%, and the corresponding maximum deviation between the obtained theoretical brightness values corresponding to respective grayscales of the display device and the actual measured brightness values corresponding to the respective grayscales of the modulated display device can be less than 21%.

In the method for modulating the brightness-grayscale curve of the display device provided in the present embodiment, the obtained theoretical brightness values corresponding to respective grayscales in the display device are compared with the actual measured brightness values corresponding to the respective grayscales in the modulated display device, and/or the obtained theoretical brightness differences corresponding to respective grayscales in the display device are compared with the actual measured brightness differences corresponding to the respective grayscales in the modulated display device. From this, it is possible to quantify the difference between the actual brightness and the ideal brightness, and the difference between the gradient of brightness and the gradient of the ideal brightness for each grayscale. It is possible to control the brightness accuracy and the smoothness of the brightness curve (i.e., the smoothness of the grayscale transition), precisely by eliminating the blind area in the commissioning process for the engineer.

Figure 10:
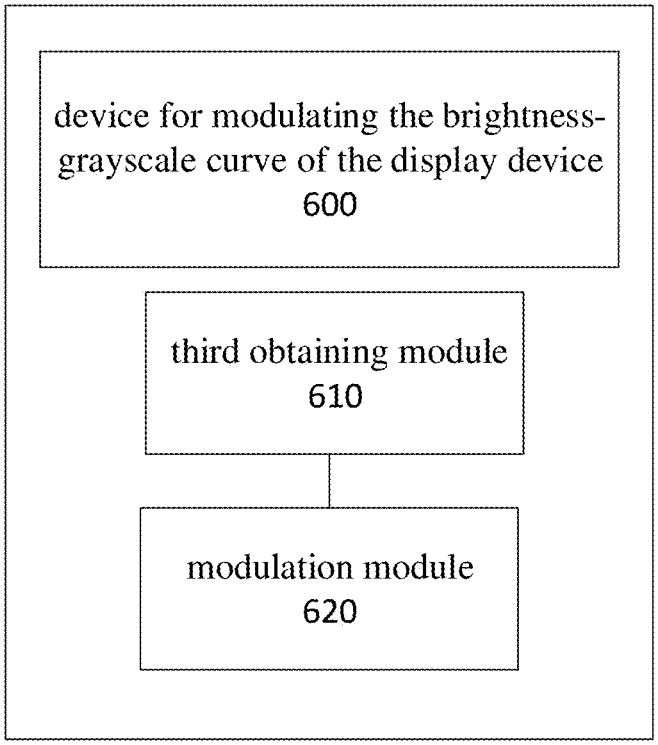
FIG. 10 is a functional block diagram illustrating a device for modulating a brightness-grayscale curve of a display device according to the embodiments of the present disclosure.

FIG. 10 is a functional block diagram illustrating a device for modulating a brightness-grayscale curve of a display device according to the embodiments of the present disclosure. If the applicable standard brightness-grayscale curve for eye perception in comfort (corresponding to $L_{perception}(n)$) is determined as a gamma curve, the method orf modulating the embodiments in the present disclosure is performed by the device 600 for modulating. The device 600 for modulating the brightness-grayscale curve of the display device is runned in an electronic terminal. The device 600 for modulating the brightness-grayscale curve of the display device may include a third obtaining module 610 and a modulation module 620.

The third obtaining module 610 is configured for obtaining theoretical brightness values corresponding to respective grayscales of the display device according to a specific gamma curve.

As an example, the gamma curve includes the following formula.

$$L_{device}(n) = L_{device-max} * \left(\frac{n + n_0}{n_{max} + n_0}\right)^{\gamma}$$

$$n_0 = \frac{n_{max}}{\left(\frac{L_{device-max}}{L_{device-min}}\right)^{\frac{1}{\gamma}} - 1}$$

where $L_{device-max}$ is the maximum brightness value of the display device, $L_{device-min}$ is the minimum brightness value of the display device, $n_{max}$ is the maximum grayscale value of the display device, $n_0$ is the intermediate factor, n is each grayscale of the display device, $L_{device}(n)$ is a theoretical brightness value corresponding to the grayscale n of the display device.

As an example, the gamma parameter is in the range from 2.0 to 2.4.

As another example, the gamma parameter is determined based on the value of an environmental factor.

Specifically, the determining gamma parameter based on the value of an environmental factor includes: when the value of the environmental factor belongs to a first environmental parameter range, the value of the gamma parameter belongs to a first gamma parameter range; when the value of the environmental factor belongs to a second environmental parameter range, the value of the gamma parameter belongs to a second gamma parameter range; wherein, the values in the first environmental parameter range are greater than the values in the second environmental parameter range, and the values in the first gamma parameter range are less than the values in the second gamma parameter range.

The modulation module 620 is configured for modulating brightnesses of the display device according to the brightness values corresponding to respective grayscales of the display device, wherein the obtained ratio of the theoretical brightness value corresponding to each grayscale in the display device to the actual measured brightness value corresponding to the grayscale of a modulated display device satisfies a first range, and/or the obtained ratio of the theoretical brightness difference corresponding to each grayscale of the display device to the actual measured difference corresponding to the grayscale in the modulated display device satisfies a second range.

As an example, the modulation module 620 is further configured for modulating the brightnesses of the display device according to the theoretical brightness values corresponding to the respective grayscales of the display device and an eye pupil change factor.

Specifically, the eye pupil change factor comprises a value corresponding to a ratio of a diameter of the eye pupil at current environment brightness to a diameter of the eye pupil at predefined environment brightness.

As an example, the first range is from 1−15% to 1+15% and the second range is from 1−30% to 1+30%.

As an example, the standard deviation between the obtained theoretical brightness values corresponding to respective grayscales of the display device and the actual measured brightness values corresponding to the respective grayscales of the modulated display device satisfies a third range, or the maximum deviation between the obtained theoretical brightness values corresponding to respective grayscales of the display device and the actual measured brightness values corresponding to the respective grayscales of the modulated display device satisfies a fourth range.

By the device for modulating the brightness-grayscale curve of the display device provided in the present embodiment, the theoretical brightness values corresponding to respective grayscales in the obtained display device are compared with the actual measured brightness values corresponding to the respective grayscales in the modulated display device, and/or the theoretical brightness differences corresponding to respective grayscales in the obtained display device are compared with the actual measured brightness differences corresponding to the respective grayscales in the modulated display device. From this, it is possible to quantify the difference between the actual brightness and the ideal brightness, and the difference between the gradient of brightness and the gradient of the ideal brightness for each grayscale. It is possible to control the brightness accuracy and the smoothness of the brightness curve (i.e., the smoothness of the grayscale transition), precisely by eliminating the blind area in the commissioning process for the engineer.

The above modules can be implemented not only by software code, but also by hardware such as IC chips.

Figure 11:
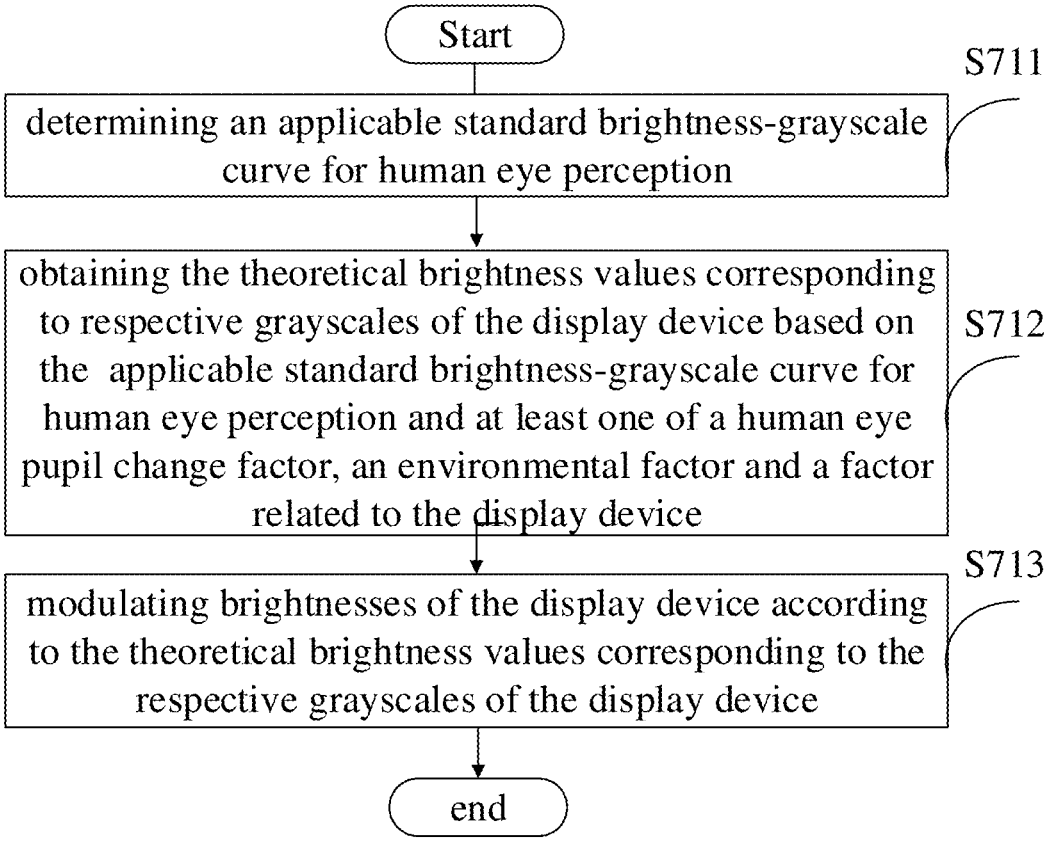
FIG. 11 is a flowchart illustrating a method for modulating a brightness-grayscale curve of a display device according to the embodiments of the present disclosure.

Referring to FIG. 11, FIG. 11 is a flowchart illustrating a modulation method for a brightness-grayscale curve of a display device according to the embodiments of the present disclosure. The modulation method includes the following steps.

At step S711, an applicable standard brightness-grayscale curve for eye perception is determined.

As an example, at step S711, an absolute standard brightness-grayscale curve for eye perception is determined, and the absolute standard brightness-grayscale curve for eye perception is converted to an applicable standard brightness-grayscale curve for eye perception.

For how to determine the absolute standard brightness-grayscale curve for eye perception and how to convert the absolute standard brightness-grayscale curve for eye perception to the applicable standard brightness-grayscale curve for eye perception, the particular manners haves been described as above and will not be repeated here.

Among them, the actual measured absolute standard brightness-grayscale curve for eye perception can be a power function curve, a logarithmic curve, a perceptual quantization curve, etc. Thus, the applicable standard brightness-grayscale curve for eye perception after conversion can also be a power function curve, a logarithmic curve, a perceptual quantization curve, etc. Among them, the gamma curve (shown below) is a power function curve and the Dolby curve (PQ curve) is a perceptual quantization curve, both of which can be implementations for an applicable standard brightness-grayscale curve for eye perception.

At step S712, theoretical brightness values corresponding to respective grayscales of the display device are obtained based on an applicable standard brightness-grayscale curve for eye perception and at least one of an eye pupil change factor, an environmental factor and a factor related to the display device.

As an example, theoretical brightness values corresponding to respective grayscales of the display device are obtained based on the factor related to the display device and the applicable standard brightness-grayscale curve for eye perception.

Among them, the factor related to the display device can include the maximum brightness value of the display device, the minimum brightness value of the display device, the maximum e grayscale value of the display device, and the respective grayscales of the display device.

Specifically, if the applicable standard brightness-grayscale curve for eye perception is a gamma curve, the theoretical brightness values of respective grayscales in the display device are obtained based on the flowchart of the method for modulating the brightness-grayscale curve of the display device in the above embodiment and related descriptions, which will not be repeated here.

As another example, the theoretical brightness values corresponding to respective grayscales of the display device are obtained based on the environmental factor, the factor related to the display device, and the applicable standard brightness-grayscale curve for eye perception.

Specifically, if the applicable standard brightness-grayscale curve for eye perception is a gamma curve, the theoretical brightness values corresponding to respective grayscales in the display device can be obtained by referring to the effect of environmental factors on eye perception in the method for modulating the brightness-grayscale curve of the display device in the above-mentioned embodiment and its related description, which will not be repeated here.

As another example, the theoretical brightness values corresponding to respective grayscales of the display device are obtained based on the eye pupil change factor, the factor related to the display device, and the applicable standard brightness-grayscale curve for eye perception.

Among them, the eye pupil change factor can include a value corresponding to a ratio of a diameter of the eye pupil at current environment brightness to a diameter of the eye pupil at predefined environment brightness.

Specifically, if the applicable standard brightness-grayscale curve for eye perception is a Dolby curve (PQ curve), theoretical brightness values corresponding to respective grayscales of the display device are obtained based on the eye pupil change factor, the factor related to the display device and the Dolby curve. For example, calculations can be made based on the following examples.

Example 6

For liquid crystal display panels modulated according to the PQ curve, since its brightness curve is calculated according to the absolute brightness formula, the PQ curve is the applicable standard brightness-grayscale curve for eye perception.

$$L_{perception}(n) = 10000*\left\{\frac{(v+v_0)^{\frac{1}{m}} - C1}{C2 - C3*(v+v_0)^{\frac{1}{m}}}\right\}^{\frac{1}{p}} \tag{36}$$

$$L_{perception-min}(n) = 10000*\left\{\frac{(v_0)^{\frac{1}{m}} - C1}{C2 - C3*(v_0)^{\frac{1}{m}}}\right\}^{\frac{1}{p}} \tag{37}$$

Then, the physical brightness curve of the display device (corresponding to the brightness value of each grayscale in the display device) should be as follows if the environment is a comfort zone for the eye in actual use.

$$L_{device}(n) = 10000*\left\{\frac{(v+v_0)^{\frac{1}{m}} - C1}{C2 - C3*(v+v_0)^{\frac{1}{m}}}\right\}^{\frac{1}{p}} \tag{38}$$

$$L_{device-min}(n) = 10000*\left\{\frac{(v_0)^{\frac{1}{m}} - C1}{C2 - C3*(v_0)^{\frac{1}{m}}}\right\}^{\frac{1}{p}} \tag{39}$$

The physical brightness curve of the display device (corresponding to the brightness value of each grayscale in the display device) should be as follows if the diameter of the eye pupil in the environment is changed to φ.

$$L_{device}(n) = \left(\frac{\Phi_0}{\phi}\right)^2 * 10000*\left\{\frac{(v+v_0)^{\frac{1}{m}} - C1}{C2 - C3*(v+v_0)^{\frac{1}{m}}}\right\}^{\frac{1}{p}} \tag{40}$$

$$L_{device-min}(n) = \left(\frac{\Phi_0}{\phi}\right)^2 * 10000*\left\{\frac{\left[(v_0)^{\frac{1}{m}} - C1\right]}{C2 - C3*(v_0)^{\frac{1}{m}}}\right\}^{\frac{1}{p}} \tag{41}$$

where $L_{device}(n)$ is a theoretical brightness value corresponding to the grayscale n of the display device, v is a video signal, 0<v<1 in volts; m=78.8438; p=0.1593; C1=0.8359; C2=18.8516; C3=18.6875; $v_0$ is a signal noise value of the display device, and $v_0$ corresponds to the minimum brightness value of the display device. Replacing the analog voltage v therein with grayscale n can be performed according to the relevant linear conversion formula, and normalization is performed.

Example 7

For display panels that display video that satisfies the HEVC (High Efficiency Video Coding) standard, a logarithmic curve is used as the applicable standard brightness-grayscale curve for eye perception.

$$V = \begin{cases} a*IN(12L_{perception}(n) - b) + c, & 1 \geq L_{perception}(n) > \frac{1}{12} \\ \sqrt{3}*L_{perception}(n)^{0.5}, & \frac{1}{12} \geq L_{perception}(n) \geq 0 \end{cases} \tag{42}$$

where V is the signal power level, $L_{perception}(n)$ is a relative brightness in a range of [0,1], a=0.17883277, b=0.28466892, and c=0.55991073.

Then, the physical brightness curve of the display device (corresponding to the brightness value of each grayscale in the display device) should be as follows if the environment is a comfort zone for the eye in actual use.

$$L_{device}(n) = L_{perception}(n) \tag{43}$$

The physical brightness curve of the display device (corresponding to the brightness value of each grayscale in the display device) should be as follows if the diameter of the eye pupil in the environment is changed to φ.

$$L_{device}(n) = \left(\frac{\Phi_0}{\phi}\right)^2 * L_{perception}(n) \tag{44}$$

Of course, it is understandable that the above values are not so limited.

As another example, the theoretical brightness values corresponding to respective grayscales of the display device are obtained based on the eye pupil change factor, the environmental factor, the factor related to the display device, and the applicable standard brightness-grayscale curve for eye perception.

Specifically, if a gamma curve is used to approximate the applicable standard brightness-grayscale curve for eye perception, the theoretical brightness values corresponding to respective grayscales in the display device can be obtained by referring to the effect of the eye pupil change factor on eye perception in the method for modulating the brightness-grayscale curve of the display device in the above-mentioned embodiment and its related description, which will not be repeated here.

At step S713, brightnesses of the display device are modulated according to the theoretical brightness values corresponding to respective grayscales of the display device.

Figure 14:
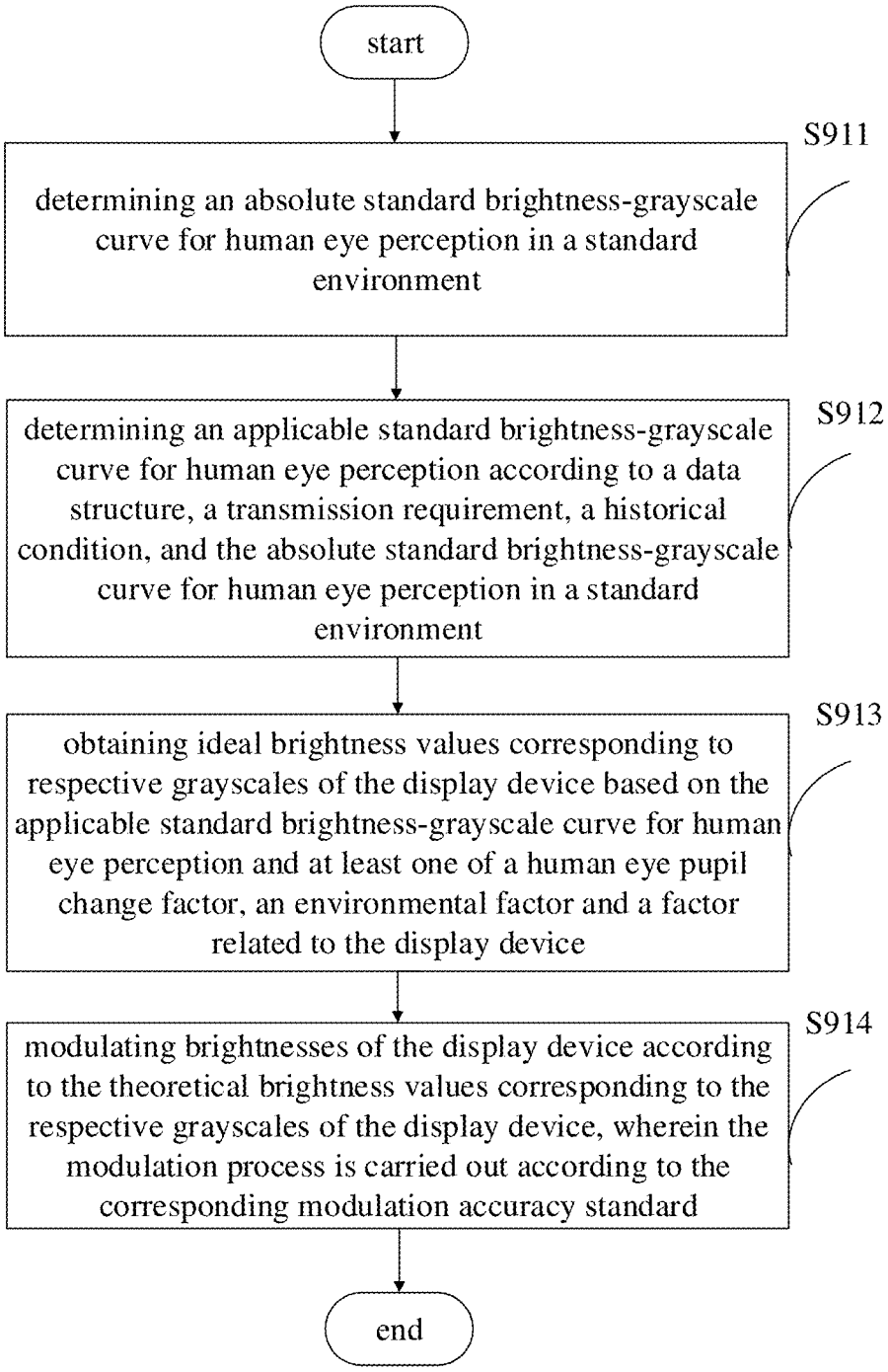
FIG. 14 shows a detailed flowchart of a method for modulating a brightness-grayscale curve of a display device according to the embodiments of the present disclosure.

As a detailed example, see FIG. 14, the details of which have been described in detail in the preceding text and are not repeated here.

Further, before determining the applicable standard brightness-grayscale curve for eye perception, the method further includes receiving each grayscale sent by the capturing terminal, wherein each grayscale is determined by the capturing terminal based on the applicable standard brightness-grayscale curve for eye perception and the brightness of the captured image.

After modulating the brightnesses of the display device, the method further includes displaying the brightness values corresponding to each grayscale received on the display device.

In this way, at the capturing end, the image is captured by a capturing device, and each grayscale is determined by using the capturing device or a separate processor based on the applicable standard brightness-grayscale curve for eye perception and the brightness of the captured image as described, and the grayscale is transmitted to the display device. The amount of transmission can be saved because only the grayscale corresponding to the pixels of the image is transmitted. At the display device end, the grayscale corresponding to the image is received by the modulated display device, and the brightness of each grayscale is displayed according to the brightness-grayscale curve of the modulated display device. Thus, a complete set of a standard architecture for capturing, transmitting, and displaying image (or video) information is provided, which can be used in a wider range of applications. By the method for modulating a brightness-grayscale curve of a display device according to the embodiments of the present disclosure, the problems of low grayscale detail, backlighting, high grayscale saturation, and transition-color unevenness and the like caused by modulation of the display device using the ideal gamma curve are solved. By considering the effect of environmental factors on eye perception, the problem is solved that modulating a display device with an ideal gamma curve would cause the visible grayscale in a dimmed session to be no longer distinguishable in a bright environment. And a quantifiable standard is provided, which fills a gap for standards in the display field.

Figure 12:
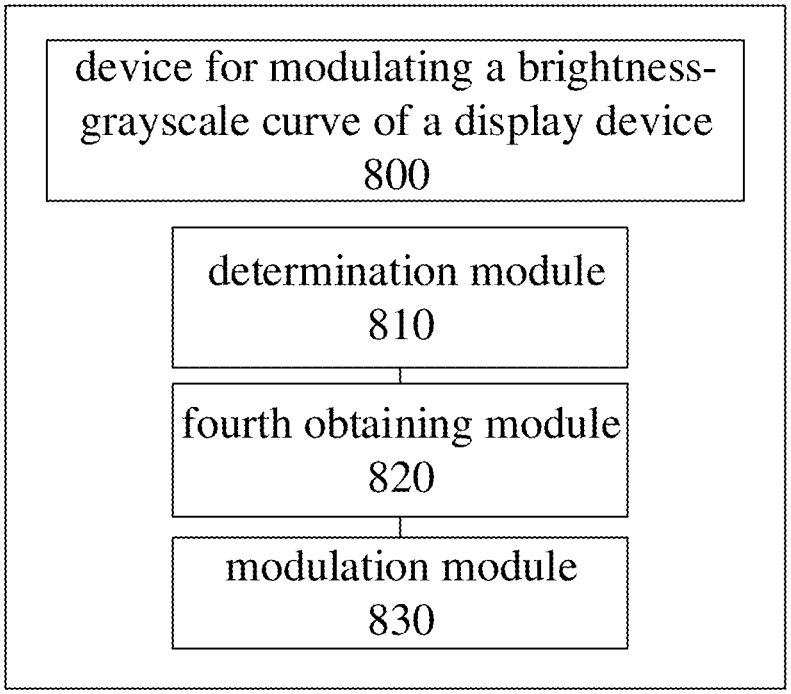
FIG. 12 is a functional block diagram illustrating a device for modulating a brightness-grayscale curve of a display device according to the embodiments of the present disclosure.

Referring FIG. 12, FIG. 12 is a functional block diagram illustrating a device for modulating a brightness-grayscale curve of a display device according to the embodiments of the present disclosure.

A device 800 for modulating a brightness-grayscale curve of a display device is operated in an electronic terminal. The device 800 for modulating the brightness-grayscale curve of the display device may include a determination module 810, a fourth obtaining module 820, and a modulation module 830.

The determination module 810 is configured for determining an applicable standard brightness-grayscale curve for eye perception.

Specifically, the determination module 810 is further configured for determining an absolute standard brightness-grayscale curve for eye perception; and converting the absolute standard brightness-grayscale curve for eye perception to applicable standard brightness-grayscale curve for eye perception.

The fourth obtaining module 820 is configured for obtaining theoretical brightness value corresponding to each grayscale of the display device based on the applicable standard brightness-grayscale curve for eye perception and at least one of an eye pupil change factor, an environmental factor and a factor related to the display device.

As an example, the fourth obtaining module is configured for obtaining theoretical brightness value corresponding to each grayscale of the display device based on the factor related to the display device and the applicable standard brightness-grayscale curve for eye perception.

As another example, the fourth obtaining module is configured for obtaining theoretical brightness value corresponding to each grayscale of the display device based on the environmental factor, the factor related to the display device and the applicable standard brightness-grayscale curve for eye perception.

As another example, the fourth obtaining module is configured for obtaining theoretical brightness value corresponding to each grayscale of the display device based on the eye pupil change factor, the factor related to the display device and the applicable standard brightness-grayscale curve for eye perception.

As another example, the fourth obtaining module is configured for obtaining theoretical brightness value corresponding to each grayscale of the display device based on the eye pupil change factor, the environmental factor, the factor related to the display device and the applicable standard brightness-grayscale curve for eye perception.

Further, as an example, the eye pupil change factor comprises a value corresponding to a ratio of a diameter of the eye pupil at current environment brightness to a diameter of the eye pupil at predefined environment brightness.

Specifically, the factor related to the display device can include the maximum brightness value of the display device, the minimum brightness value of the display device, the maximum grayscale value of the display device, and the respective grayscales of the display device.

The modulation module 830 is configured for modulating brightnesses of the display device according to the theoretical brightness value corresponding to each grayscale of the display device.

Further, the device may further comprise a processing module 840 (not shown in the drawings). The processing module 840 is configured for receiving each grayscale sent by the capturing terminal before determining the applicable standard brightness-grayscale curve for eye perception, wherein each grayscale is determined by the capturing terminal based on the applicable standard brightness-grayscale curve for eye perception and the brightness of the captured image; and after modulating the brightnesses of the display device, displaying the brightness value corresponding to each grayscale received on the display device.

By the device for modulating a brightness-grayscale curve of a display device according to the embodiments of the present disclosure, the problems of low grayscale detail, backlighting, high grayscale saturation, and transition-color unevenness and the like caused by modulation of the display device using the ideal gamma curve are solved. By considering the effect of environmental factors on eye perception, the problem is solved that the modulating a display device with an ideal gamma curve would cause the visible grayscale in a dimmed session to be no longer distinguishable in a bright environment. And a quantifiable standard is provided, which fills a gap for standards in the display field.

The above modules can be implemented not only by software code, but also by hardware such as IC chips.

An electronic device is provided by the embodiments of the present disclosure. The electronic device includes a display device, a memory, and a processor. The processor is coupled to the display device and the memory respectively. The memory stores instructions, wherein the above-mentioned modulation method is executed when the instructions are executed by the processor.

Figure 13:
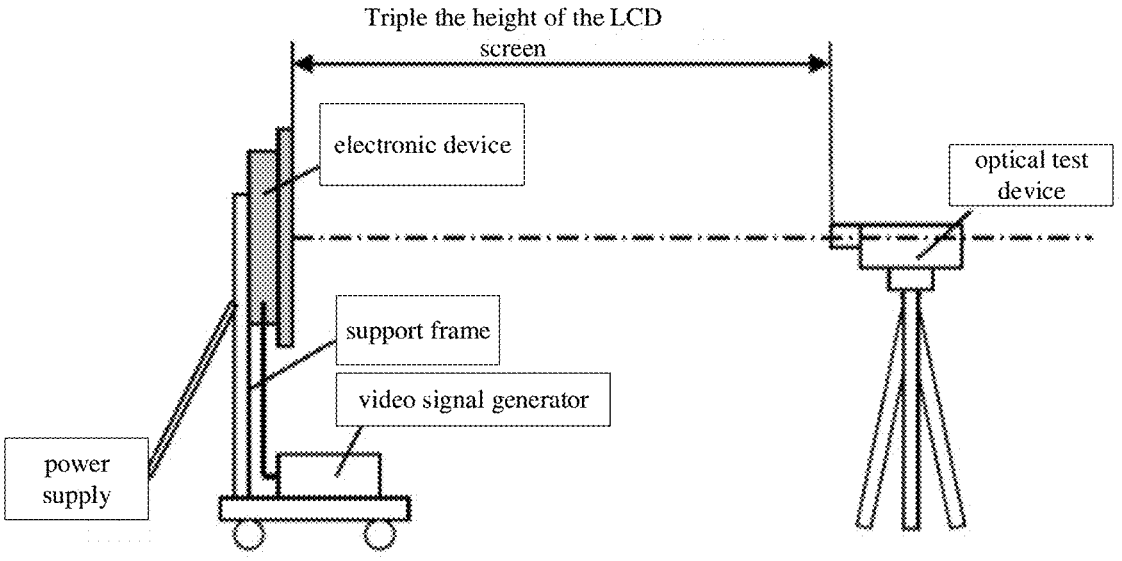
FIG. 13 shows a measured environment diagram including an electronic device.

Referring FIG. 13, FIG. 13 shows a measured environment diagram including an electronic device. Among them, the electronic device shown includes a display device, a memory, and a processor, and the electronic device is placed on a support frame and coupled to a power supply, a video signal generator, and an optical test device, respectively. Among them, the eye perception brightness curve $L_{perception}$ can be pre-stored in the memory of the electronic device. Alternatively, the eye perception brightness curve $L_{perception}$ can be determined by the processor of the electronic device. The video signal (corresponding to the grayscale value) is input into the electronic device through a video signal generator. First, the maximum brightness value $L_{device\text{-}max}$ (corresponding to the grayscale value $n=n_{max}$) and the minimum brightness value $L_{device\text{-}min}$ (corresponding to the grayscale value n=0) of the display device of the electronic device are obtained. By changing the grayscale value of the video signal input and combining it with the eye perception brightness curve $L_{perception}$, the theoretical brightness value $L_{device}(n)$ corresponding to each grayscale of the display device is modulated. The actual measured brightness value $L_{measure}(n)$ of the modulated display is obtained by the optical test equipment.

By the electronic device according to the embodiments of the present disclosure, the problems of low grayscale detail, backlighting, high grayscale saturation, and transition-color unevenness and the like caused by modulation of the display device using the ideal gamma curve are solved. By considering the effect of environmental factors on eye perception, the problem is solved that modulating a display device with an ideal gamma curve would cause the visible grayscale in a dimmed session to be no longer distinguishable in a bright environment. And a quantifiable standard is provided, which fills a gap for standards in the display field.

It should be noted that each embodiment in this specification is described in a progressive manner, that each embodiment focuses on differences from other embodiments, and that it is sufficient to refer to each embodiment for similarities.

The device for modulating the brightness-grayscale curve of the display device provided in this embodiment has the same implementation principle and technical effect as the aforementioned method embodiment, and for a brief description, contents which are not mentioned in the device embodiments can be obtained by referring to the corresponding contents in the aforementioned method embodiments.

In the several embodiments provided in the present application, it should be understood that the devices and methods disclosed may also be implemented in other ways. The device embodiments described above are merely illustrative, for example, the flowcharts and block diagrams in the accompanying drawings show possible architectures, functions and operations of the devices, methods and computer program products according to multiple embodiments of the present disclosure. In this regard, each box in a flowchart or block diagram may represent a module, segment or part of code that contains one or more executable instructions to achieve the specified logical function. It should also be noted that in some implementations as replacements, the functions indicated in the box may also occur in a different order than in the accompanying drawing. For example, actually, two successive boxes can be executed virtually parallel, or they can sometimes be executed in reverse order, depending on the function involved. It should also be noted that each box in the block diagram and/or flowchart, and the combination of boxes in the block diagram and/or flowchart, can be implemented with a dedicated hardware-based system that performs the specified function or action, or with a combination of dedicated hardware and computer instructions.

Alternatively, the individual functional modules in each embodiment of the present disclosure may be integrated together to form a separate portion, or the individual modules may exist separately, or two or more modules may be integrated into a separate portion.

The functions described may be stored in a computer-readable storage medium when the functions implemented in the form of a software function module and sold or used as a stand-alone product. It is understood that the technical scheme of the present disclosure in essence or that part of the contribution to the prior art or part of the technical scheme may be embodied in the form of a software product, the computer software product being stored in a storage medium and including multiple instructions to enable a computer device (which may be a personal computer, server, or network device, etc.) to perform all or part of the steps of the methods described in the various embodiments of the present disclosure. The aforementioned storage media includes USB flash drive, mobile hard disk, read-only memory (ROM, Read-Only Memory), random access memory (RAM, Random Access Memory), disk or CD-ROM and other kinds of media can store program code. It should be noted that in this paper, relationship terms such as first and third are used only to distinguish one entity or operation from another, and do not necessarily require or imply any such actual relationship or sequence between them. Moreover, the terms "includes", "contains" or any other variant thereof are intended to cover non-exclusive inclusion, so that a process, method, article or device that includes a series of elements includes not only those elements but also other elements not expressly listed, or also elements inherent to such process, method, article or device. Without further limitation, the qualification of an element by the phrase "including a . . . " does not preclude the existence of another identical element in the process, method, article or equipment that includes the said element.

The foregoing is only an example of the present disclosure and is not intended to limit the present disclosure, which is subject to various changes and variations for technical personnel in the field. Any modifications, equivalents, improvements, etc. made within the spirit and principles of this disclosure shall be covered by the protection scope of this disclosure. It should be noted that similar symbols and letters indicate similar items in the accompanying diagrams below, so that once an item is defined in one diagram, it does not require further definition and explanation in subsequent diagrams.

The foregoing is only a specific implementation of this disclosure, but the scope of protection of this disclosure is not limited thereto, and any changes or replacements that can be readily conceived by those ordinary in the art within the scope of the art disclosed herein shall be covered by the scope of protection of this disclosure. Accordingly, the scope of protection of this disclosure shall be determined by the scope of protection of the attached claims and their equivalents.

What is claimed is:

1. A method for modulating a brightness-grayscale curve of a display device, comprising:

obtaining theoretical brightness values corresponding to respective grayscales of the display device according to a maximum brightness value of the display device, a minimum brightness value of the display device, a maximum grayscale value of the display device, and a gamma parameter related to the display environment;

modulating brightnesses of the display device according to the theoretical brightness values corresponding to the respective grayscales of the display device, wherein the obtaining theoretical brightness values corresponding to respective grayscales of the display device according to a maximum brightness value of the display device, a minimum brightness value of the display device, a maximum grayscale value of the display device, and a gamma parameter associated with the display environment comprises:

obtaining an intermediate factor according to the maximum brightness value of the display device, the minimum brightness value of the display device, the maximum grayscale value of the display device, and the gamma parameter related to the display environment;

obtaining the theoretical brightness values for the respective grayscales of the display device according to the maximum brightness value of the display device, the maximum grayscale value of the display device, and the intermediate factor wherein, calculating the intermediate factor according to the following formula:

$$n_0 = \frac{n_{max}}{\left(\frac{L_{device-max}}{L_{device-min}}\right)^{\frac{1}{\gamma}} - 1}$$

wherein, $L_{device-max}$ is the maximum brightness value of the display device, $L_{device-min}$ is the minimum brightness value of the display device, $n_{max}$ is the maximum grayscale value of the display device, $\gamma$ is the gamma parameter related to the display environment, and $n_0$ is the intermediate factor.

2. The method according to claim 1, wherein the obtaining theoretical brightness values corresponding to respective grayscales of the display device according to a maximum brightness value of the display device, a minimum brightness value of the display device, a maximum grayscale value of the display device, and a gamma parameter related to the display environment comprises:

calculating a gamma curve based on the maximum brightness value of the display device, the minimum brightness value of the display device, the maximum grayscale value of the display device, and the gamma parameter related to the display environment;

obtaining the theoretical brightness values corresponding to the respective grayscales of the display device according to the gamma curve;

wherein, an intermediate factor of the gamma curve is calculated based on the maximum brightness value of the display device, the minimum brightness value of the display device, the maximum grayscale value of the display device, and the gamma parameter related to the display environment.

3. The method according to claim 1, wherein the theoretical brightness values corresponding to the respective grayscales of the display device are obtained according to the following formula:

$$L_{device}(n) = L_{device-max} * \left(\frac{n + n_0}{n_{max} + n_0}\right)^{\gamma}$$

wherein, $L_{device-max}$ is the maximum brightness value of the display device, $n_{max}$ is the maximum grayscale value of the display device, $n_0$ is the intermediate factor, n is each grayscale of the display device, $L_{device}$ (n) is a theoretical brightness value corresponding to the grayscale n of the display device, and $\gamma$ is the gamma parameter related to the display environment.

4. The method according to claim 1, wherein the gamma parameter is calculated based on a value of an environmental factor.

5. The method according to claim 1, wherein the modulating brightnesses of the display device according to the theoretical brightness values corresponding to the respective grayscales of the display device comprises:

modulating the brightnesses of the display device according to an eye pupil change factor and the theoretical brightness values corresponding to the respective grayscales of the display device.

6. The method according to claim 5, wherein the eye pupil change factor comprises a value corresponding to a ratio of a diameter of the eye pupil at current environment brightness to a diameter of the eye pupil at standard environment brightness.

7. The method according to claim 1, wherein, for each of the respective grayscales, the ratio of the obtained theoretical brightness value corresponding to the grayscale in the display device to the actual measured brightness value corresponding to the grayscale of a modulated display device is within a first range, and/or the ratio of the obtained theoretical brightness difference corresponding to the grayscale of the display device to the actual measured brightness difference corresponding to the grayscale in the modulated display device is within a second range.

8. The method according to claim 1, wherein a standard deviation between the obtained theoretical brightness values corresponding to the respective grayscales of the display device and the actual measured brightness values corresponding to the respective grayscales of the modulated display device is within a third range, or a maximum deviation between the obtained theoretical brightness values corresponding to the respective grayscales of the display device and the actual measured brightness values corresponding to the respective grayscales of the modulated display device is within a fourth range.

9. A non-transient computer-readable recording medium, on which a program for performing the method for modulating of claim 1 is recorded.

10. A method for modulating a brightness-grayscale curve of a display device, comprising:

calculating an applicable standard brightness-grayscale curve for eye perception;

obtaining theoretical brightness values corresponding to respective grayscales of the display device based on the applicable standard brightness-grayscale curve for eye perception and at least one of an eye pupil change factor, an environmental factor and a factor related to the display device;

modulating brightnesses of the display device according to the theoretical brightness values corresponding to the respective grayscales of the display device, wherein the obtaining theoretical brightness values corresponding to respective grayscales of the display device based on the applicable standard brightness-grayscale curve for eye perception and at least one of an eye pupil change factor, an environmental factor and a factor related to the display device comprises:

obtaining the theoretical brightness values corresponding to the respective grayscales of the display device based on the eye pupil change factor, the factor related to the display device, and the applicable standard brightness-grayscale curve for eye perception, and wherein the factor related to the display device includes a minimum brightness value of the display device, and the obtaining the theoretical brightness values corresponding to respective grayscales of the display device based on the eye pupil change factor, the factor related to the display device, and the applicable standard brightness-grayscale curve for eye perception comprises: for each of the respective grayscales, calculating the theoretical brightness value according to a formula $$L_{device}(n) = \left(\frac{\Phi_0}{\Phi}\right)^{2*} 10000^* \left\{\frac{(v+v_0)^{\frac{1}{m}} - C1}{C2 - C3^*(v+v_0)^{\frac{1}{m}}}\right\}^{\frac{1}{p}}$$

or according to a formula $$L_{device}(n) = 10000^* \left\{\frac{(v+v_0)^{\frac{1}{m}} - C1}{C2 - C3^*(v+v_0)^{\frac{1}{m}}}\right\}^{\frac{1}{p}};$$

wherein, $L_{device}(n)$ is a theoretical brightness value corresponding to the grayscale n of the display device, v is a video signal, 0<v<1 in volts; m=78.8438; p=0.1593; C1=0.8359; C2=18.8516; C3=18.6875; $v_0$ is a signal noise value of the display device; $v_0$ corresponds to the minimum brightness value of the display device; $\phi_0$ is a pupil diameter of the eye in a standard environment; and $\phi$ is a pupil diameter of the eye in a display environment.

11. An electronic device, comprising a display device, a memory, and a processor, wherein the processor is coupled to the display device and the memory respectively, the memory stores instructions, wherein a method for modulating is executed when the instructions are executed by the processor, the method comprises:

obtaining theoretical brightness values corresponding to respective grayscales of the display device according to a maximum brightness value of the display device, a minimum brightness value of the display device, a maximum grayscale value of the display device, and a gamma parameter related to the display environment;

modulating brightnesses of the display device according to the theoretical brightness values corresponding to the respective grayscales of the display device, wherein the obtaining theoretical brightness values corresponding to respective grayscales of the display device according to a maximum brightness value of the display device, a minimum brightness value of the display device, a maximum grayscale value of the display device, and a gamma parameter related to the display environment comprises:

calculating a gamma curve based on the maximum brightness value of the display device, the minimum brightness value of the display device, the maximum grayscale value of the display device, and the gamma parameter related to the display environment;

obtaining the theoretical brightness values corresponding to the respective grayscales of the display device according to the gamma curve;

wherein, an intermediate factor of the gamma curve is calculated based on the maximum brightness value of the display device, the minimum brightness value of the display device, the maximum grayscale value of the display device, and the gamma parameter related to the display environment, and wherein calculating the intermediate factor according to the following formula:

$$n_0 = \frac{n_{max}}{\left(\frac{L_{device-max}}{L_{device-min}}\right)^{\frac{1}{\gamma}} - 1}$$

wherein, $L_{device-max}$ is the maximum brightness value of the display device, $L_{device-min}$ is the minimum brightness value of the display device, $n_{max}$ is the maximum grayscale value of the display device, $\gamma$ is the gamma parameter related to the display environment, and $n_0$ is the intermediate factor.

12. The electronic device according to claim 11, wherein the obtaining theoretical brightness values corresponding to respective grayscales of the display device according to a maximum brightness value of the display device, a minimum brightness value of the display device, a maximum grayscale value of the display device, and a gamma parameter associated with the display environment comprises:

obtaining an intermediate factor according to the maximum brightness value of the display device, the minimum brightness value of the display device, the maximum grayscale value of the display device, and the gamma parameter related to the display environment;

obtaining the theoretical brightness values for the respective grayscales of the display device according to the maximum brightness value of the display device, the maximum grayscale value of the display device, and the intermediate factor.

13. The electronic device according to claim 11, wherein the modulating brightnesses of the display device according to the theoretical brightness values corresponding to the respective grayscales of the display device comprises:

modulating the brightnesses of the display device according to an eye pupil change factor and the theoretical brightness values corresponding to the respective grayscales of the display device.

* * * * *